US007337943B2

(12) United States Patent
Johns et al.

(10) Patent No.: US 7,337,943 B2
(45) Date of Patent: Mar. 4, 2008

(54) DISPOSABLE SERVINGWARE CONTAINERS WITH FLANGE TABS

(75) Inventors: Albert D. Johns, Saylorsburg, PA (US); Mark B. Littlejohn, Appleton, WI (US); Jay S. Lester, Fairfield, CT (US); Mircea Sofronie, Easton, PA (US); Thomas W. Zelinski, Menasha, WI (US); William R. Pucci, Winneconne, WI (US); Richard J. Rogers, Neenah, WI (US); Erik J. Sjogren, Atlanta, GA (US)

(73) Assignee: Dixie Consumer Products LLC, Atlanta, GA (US)

( * ) Notice: Subject to any disclaimer, the term of this patent is extended or adjusted under 35 U.S.C. 154(b) by 619 days.

(21) Appl. No.: 10/600,814

(22) Filed: Jun. 20, 2003

(65) Prior Publication Data

US 2004/0069788 A1 Apr. 15, 2004

Related U.S. Application Data

(60) Provisional application No. 60/392,091, filed on Jun. 27, 2002.

(51) Int. Cl.
*B65D 1/34* (2006.01)
*B65D 1/36* (2006.01)

(52) U.S. Cl. ..... 229/406; 206/459.1; 220/555; 220/556; 220/574; 220/575; D7/545; D7/578; D7/628

(58) Field of Classification Search ..... 229/406, 229/407; 220/556, 575, 543, 544, 545, 574, 220/769, 771, 772, 553, 554, 555; 206/459.1, 206/459.5; D7/391, 521, 543, 545, 548, D7/578, 628

See application file for complete search history.

(56) References Cited

U.S. PATENT DOCUMENTS

| | | | | | |
|---|---|---|---|---|---|
| 255,726 | A | * | 3/1882 | David | 220/23.8 |
| D30,561 | S | * | 4/1899 | Schubert | D7/555 |
| 1,196,803 | A | * | 9/1916 | Mulholland | 40/324 |
| D83,595 | S | * | 3/1931 | Boardman | D7/556 |
| 1,848,066 | A | * | 3/1932 | Shepard et al. | 220/575 |
| 1,943,698 | A | * | 1/1934 | Schurmann | 220/575 |
| 4,606,496 | A | | 8/1986 | Marx et al. | 229/2.5 R |
| 4,609,140 | A | | 9/1986 | Van Handel et al. | 229/2.5 R |
| 4,721,499 | A | | 1/1988 | Marx et al. | 493/152 |
| 4,721,500 | A | | 1/1988 | Van Handel et al. | 493/152 |
| 4,781,566 | A | | 11/1988 | Rossi et al. | 425/400 |
| 4,832,676 | A | | 5/1989 | Johns et al. | 493/152 |
| 5,088,640 | A | | 2/1992 | Littlejohn | 229/2.5 R |
| 5,203,491 | A | | 4/1993 | Marx et al. | 229/2.5 R |
| 5,236,119 | A | * | 8/1993 | Chu | 229/407 |
| 5,249,946 | A | | 10/1993 | Marx | 425/142 |
| 5,326,020 | A | | 7/1994 | Cheshire et al. | 229/2.5 R |
| 5,588,587 | A | * | 12/1996 | Stier et al. | 229/232 |
| 5,603,996 | A | | 2/1997 | Overcash et al. | 428/34.2 |
| 5,776,619 | A | | 7/1998 | Shanton | 428/511 |
| D468,589 | S | * | 1/2003 | Bulcher et al. | D7/553.1 |
| 6,571,980 | B2 | * | 6/2003 | Littlejohn et al. | 220/574 |
| D501,364 | S | * | 2/2005 | Tranfaglia et al. | D7/543 |

* cited by examiner

*Primary Examiner*—Gary E Elkins

(57) ABSTRACT

Disposable containers include peripheral tabs which are useful for positioning and processing the containers and operate as separators. In a preferred embodiment, the tabs correspond to tabs on a paperboard blank where the tabs are useful for controlling the orientation of the blanks so that printed and shape features may be kept in registration during manufacturing of a disposable servingware container.

54 Claims, 23 Drawing Sheets

DISPOSABLE SERVINGWARE CONTAINERS WITH FLANGE TABS

CLAIM FOR PRIORITY

This non-provisional application claims the benefit of the filing date of U.S. Provisional Patent Application Ser. No. 60/392,091, of the same title, filed Jun. 27, 2002.

TECHNICAL FIELD

The present invention relates to disposable containers such as paper or plastic plates, platters, deep dishes or bowls provided with one or more flange tabs useful for processing or separating the containers. Tabs on the paperboard blank enable controlling the orientation of the blank during processing into a container. This feature makes it possible to maintain registration between printed character attributes, for example, and press-formed physical features of the container such as compartment ribs, embossments or debossments. A preferred container is formed from a generally planar, scored paperboard blank provided with tabs which is formed into the disposable container.

BACKGROUND ART

Disposable containers are made from a suitable feedstock material by way of a variety of processes employing many types of equipment. Such materials, techniques and equipment are well known to those of skill in the art.

Paper disposable food containers may be made by way of pulp-molding processes or by way of pressing a planar paperboard container blank in a matched metal heated die set. Pressed paperboard containers may be made as noted in one or more of U.S. Pat. No. 4,606,496 entitled "Rigid Paperboard Container" of R. P. Marx et al.; U.S. Pat. No. 4,609,140 entitled "Rigid Paperboard Container and Method and Apparatus for Producing Same" of G. J Van Handel et al.; U.S. Pat. No. 4,721,499 entitled "Method of Producing a Rigid Paperboard Container" of R. P. Marx et al.; U.S. Pat. No. 4,721,500 entitled "Method of Forming a Rigid Paper-Board Container" of G. J. Van Handel et al.; and U.S. Pat. No. 5,203,491 entitled "Bake-In Pres-Formed Container" of R. P. Marx et al. Equipment and methods for making paperboard containers are also disclosed in U.S. Pat. No. 4,781,566 entitled "Apparatus and Related Method for Aligning Irregular Blanks Relative to a Die Half" of A. F. Rossi et al.; U.S. Pat. No. 4,832,676 entitled "Method and Apparatus for Forming Paperboard Containers" of A. D. Johns et al.; and U.S. Pat. No. 5,249,946 entitled "Plate Forming Die Set" of R. P. Marx et al. The forming section may typically include a plurality of reciprocating upper die halves opposing, in facing relationship, a plurality of lower die halves. The upper die halves are mounted for reciprocating movement in a direction that is oblique or inclined with respect to the vertical plane. The paperboard blanks, after cutting, are gravity fed to the inclined lower die halves in the forming section. The construction of the die halves and the equipment on which they are mounted may be substantially conventional; for example, as utilized on presses manufactured by the Peerless Manufacturing Company. For paperboard plates stock of conventional thicknesses, i.e., in the range of from about 0.010 to about 0.040 inches, it is preferred that the spacing between the upper die surface and the lower die surface decline continuously from the nominal paperboard thickness at the center to a lower value at the rim.

The paperboard which is formed into the blanks is conventionally produced by a wet laid paper making process and is typically available in the form of a continuous web on a roll. The paperboard stock is preferred to have a basis weight in the range of from about 100 pounds to about 400 pounds per 3000 square foot ream and a thickness or caliper in the range of from about 0.010 to about 0.040 inches as noted above. Lower basis weights and caliper paperboard is preferred for ease of forming and realizing savings in feedstock costs. Paperboard stock utilized for forming paper plates is typically formed from bleached pulp furnish, and is usually impregnated with starch and double clay coated on one side as is further discussed herein.

In a typical forming operation, the web of paperboard stock is fed continuously from a roll through a cutting die to form circular blanks which are then fed into position between the upper and lower die halves. The die halves are heated to aid in the forming process. It has been found that best results are obtained if the upper die half and lower die half—particularly the surfaces thereof—are generally maintained at a temperature in the range of from about 250° F. to about 400° F. These die temperatures have been found to facilitate the plastic deformation of paperboard in the rim areas if the paperboard has the preferred moisture levels. At these preferred die temperatures, the amount of heat applied to the blank is sufficient to liberate the moisture within the blank and thereby facilitate the deformation of the fibers without overheating the blank and causing blisters from liberation of steam or scorching the blank material. It is apparent that the amount of heat applied to the paperboard will vary with the amount of time that the dies dwell in a position pressing the paperboard together. The preferred die temperatures are based on the usual dwell times encountered for normal plate production speeds of 40 to 60 pressings a minute, and commensurately higher or lower temperatures in the dies would generally be required for higher or lower production speeds, respectively.

Paperboard for disposable pressware typically includes a coating. Illustrative in this regard are U.S. Pat. No. 5,776,619 to Shanton and U.S. Pat. No. 5,603,996 to Overcash et al. The '619 patent discloses plate stock provided with a base coat which includes a styrene-acrylic polymer as well as a clay filler as a base coat as well as a top coat including another styrene acrylic polymer and another clay filler. The use of fillers is common in the art as may be seen in the '996 patent to Overcash et al. In the '996 patent a polyvinyl alcohol polymer is used together with an acrylic emulsion as well as a clay to form a barrier coating for a paperboard oven container. See Column 12, lines 50 and following. Indeed, various coatings for paper form the subject matter of many patents including the following: U.S. Pat. No. 5,981,011 to Overcash et al.; U.S. Pat. No. 5,334,449 to Bergmann et al.; U.S. Pat. No. 5,169,715 to Maubert et al.; U.S. Pat. No. 5,972,167 to Hayasaka et al.; U.S. Pat. No. 5,932,651 to Liles et al.; U.S. Pat. No. 5,869,567 to Fujita et al.; U.S. Pat. No. 5,852,166 to Gruber et al.; U.S. Pat. No. 5,830,548 to Andersen et al.; U.S. Pat. No. 5,795,923 to Janssen et al.; U.S. Pat. No. 5,770,303 to Weinert et al.; U.S. Pat. No. 4,997,682 to Coco; U.S. Pat. No. 4,609,704 to Hausman et al.; U.S. Pat. No. 4,567,099 to Van Gilder et al.; and U.S. Pat. No. 3,963,843 to Hitchmough et al.

Various methods of applying aqueous polymer coatings and smoothing them are known in the art. See U.S. Pat. No. 2,911,320 to Phillips; U.S. Pat. No. 4,078,924 to Keddie et al.; U.S. Pat. No. 4,238,533 to Pujol et al.; U.S. Pat. No. 4,503,096 to Specht; U.S. Pat. No. 4,898,752 to Cavagna et al.; U.S. Pat. No. 5,033,373 to Brendel et al.; U.S. Pat. No.

5,049,420 to Simons; U.S. Pat. No. 5,340,611 to Kustermann et al.; U.S. Pat. No. 5,609,686 to Jerry et al.; and U.S. Pat. No. 4,948,635 to Iwasaki.

Likewise, disposable food containers are oftentimes plastic or polymer articles made from thermoplastic polymers such as styrene polymers or polypropylene. Techniques for forming such disposable food containers include injection molding, thermoforming and the like. A preferred method is thermoforming due to its speed and suitability for lower caliper materials. In the simplest form, thermoforming is the draping of a softened sheet over a shaped mold. In the more advanced form, thermoforming is the automatic high speed positioning of a sheet having an accurately controlled temperature into a pneumatically actuated forming station whereby the article's shape is defined by the mold, followed by trimming and regrind collection as is well known in the art. Suitable materials and techniques for fabricating the disposable containers of the present invention from thermoplastic materials appear in U.S. Pat. No. 6,211,501 to McCarthy et al. as well as U.S. Pat. No. 6,211,500 to Cochran II et al.

Configurations for disposable food containers have been improved over the years. One configuration which has enjoyed substantial commercial success is shown in U.S. Pat. No. 5,088,640 to Littlejohn. The '640 patent discloses a disposable plate provided with a smooth outer profile which defines four radii of curvature subtending arcs of the outer portions of the plate. The various radii are selected for enhancing rigidity of the pressed paper plate as compared to other conventional designs made from the same paperboard stock. The flowing arcuate design of the '640 patent offers additional advantages, notably with respect to manufacturing. It is possible to achieve high press speeds with design of the '640 patent, exercise pleating control and maintain product consistency, even when product is formed slightly off-center due to the forgiving tolerances inherent in the design.

Another configuration for pressed paperboard food containers which has also enjoyed substantial commercial success is taught in U.S. Pat. No. 5,326,020 to Chesire et al. A pressed paper plate configured according to the '020 patent includes three frustoconical or linear profiled regions about its sidewall and rim. The sidewall region includes a generally annular region flaring upwardly and outwardly from a periphery of a planar inner region and a first frustoconical, linear profiled region adjoining the annular region with the frustoconical region sloping outwardly and upwardly from the annular region. The rim region includes an outwardly flaring arcuate annular region adjoining an outer periphery of the first frustoconical region, and a second frustoconical region extending generally tangentially from the arcuate annular region. The second frustoconical or linear profiled region extends outwardly and downwardly at an angle of about 6° to about 12° and preferably about 6°-10.5° relative to the plane defined by the planar inner region. The rim of the container further includes an outwardly and downwardly flaring frustoconical lip with a linear profile adjoining an outer periphery of the second frustoconical region in order to aid in grasping of the paperboard container by the consumer. Additionally, a plurality of radially extending mutually spaced pleats are also formed in the rim region and are internally bonded with portions of the rim region during formation of the paperboard container by a die press. Pressed paperboard containers configured in accordance with the '020 patent are capable of exhibiting very high rigidity.

Disposable servingware articles are sometimes produced with compartments, for example a three compartment plate, or provided with novelty printed images thereon. One current product includes printed animal features on a paper plate with peripheral compartments which maybe configured to resemble "ears", "fins", "feet" or other character attributes. These products are sold under the trademark ZOOPALS™ by PACTIV. The articles appear relatively difficult to form at high production speeds, may require specialized non-uniform scoring and may require either intricate two-step trim and form in place tooling or substantial post-form trimming to achieve a uniform outer perimeter and the desired aesthetics. These products are of relatively small diameter (7-⅜" or so) and tend to have lower strength at a given material weight than products of the present invention because of their flange design. The physical design of these plates, without character features, is seen in issued United States Design Pat. No. D468,589. Further details are seen in the following published patent applications: U.S. Ser. Nos. 10/251,218; 10/251,705; and 10/251,745 respectively Publication Nos. 2003/0070956; 2003/0066776; and 2003/0046903. Each of the foregoing applications is entitled "Compartmented Plates Having Themes and Method for Manufacturing and Packaging the Same".

Other patents of general interest include U.S. Pat. No. 4,863,033 which discloses a plate with animal characters around its brim; U.S. Pat. No. 3,938,726 which shows a container with flange tabs; U.S. Pat. No. 2,121,654 which discloses a dish with angular rim portions; and U.S. Pat. No. 730,082 which shows a support dish with a paper insert, wherein the paper insert has a tab projection adapted to interlock with the support dish.

It is an object of the present invention to provide containers readily formable from blanks at relatively high production speeds with printed images in predetermined locations without the need for intricate machinery or substantial post-forming trimming. Typical speeds for plate manufacture are 40-60 cycles per minute and more, while bowls tend to run a little slower due to their deeper shape. Manufacturing speeds for bowls of 25-30 cycles per minute are readily achieved. The containers of the invention can be formed from paperboard blanks with uniformly spaced scoring and tend to have a higher strength per material weight in typical designs.

Another object of the present invention is to provide for each of manufacture and subsequent use and processing of disposable containers.

Still further objects and advantages of the present invention will become apparent from the discussion which follows.

SUMMARY OF INVENTION

There is provided in one aspect of the invention a disposable servingware container which generally includes: a generally planar bottom portion; a first annular transition portion extending upwardly and outwardly form the generally planar bottom portion; optionally a sidewall portion extending upwardly and outwardly from the first annular transition portion; a second annular transition portion flaring outwardly from the optional sidewall portion and/or outwardly with respect to the first annular transition portion; an outer flange portion extending outwardly with respect to the second annular transition portion defining generally the container perimeter having a characteristic diameter and at least first and second generally planar peripheral tabs extending outwardly from the flange portion of the container generally beyond the container perimeter. The flange may be flat, arcuate or include a combination of flat and arcuate portions. The tabs preferably extend in a direction generally parallel to the generally planar bottom portion of the container and are configured so as to define a first cross-tab dimension between their outer edges generally parallel to and of like extent, that is, approximately equal in length with a corresponding transverse dimension across the perimeter of the container. When formed in a pressware die set, the tabs are typically oriented to be parallel with the container bottom. Springback due to elastic memory of the material or distortion during packaging may change their orientation in the finished product somewhat. The tabs may be angled upwardly or downwardly, ±20° or more from a direction parallel to the bottom of the container, for example. The tabs maybe relatively closely spaced with respect to one another or further apart (as would be the case with smaller tabs) so long as the cross-tab dimension is of like extent with a corresponding transverse dimension across the perimeter of the container. The transverse dimension across the perimeter of the container (or paperboard blank) is a diameter for round articles. For other shapes a suitable dimension across the article is selected based on the processing or product attributes desired.

The first and second tabs typically extend outwardly from the perimeter of the container generally a distance of from about 0.02 to about 0.3 times the characteristic diameter, whereas a distance of from about 0.1 to about 0.3 times the characteristic diameter is typical in some embodiments. The container may have a generally round shape such that the container perimeter is a circle having a diameter, D, and the first cross-tab dimension defined by the first and second peripheral tabs is generally equal in length to the diameter, D. So also, the ratio of the height of the container to the characteristic diameter thereof is from about 0.05 to about 0.3 and the generally planar bottom portion may be provided with a plurality of upwardly projecting ribs which divide the container into a plurality of serving sections or compartments. Several salient relative dimensions are summarized in Table 1 below.

TABLE 1

Container Geometric Feature Summary

| Feature | General | Typical | Preferred |
|---|---|---|---|
| Tab Extension/Diameter Ratio | 0.02-0.3 | 0.1-0.3 | 0.15-0.25 |
| Height/Diameter Ratio | 0.05-0.3 | — | — |
| Tab Radius of Curvature/ Diameter Ratio | 0.01-0.4 | 0.05-0.35 | 0.1-0.35 or 0.15-0.35 |

In compartmented plates, the ribs typically project upwardly from the bottom portion at most about 0.75 times the height of the container and preferably at most about 0.6 times the height of the container. Compartmented plates preferably have one compartment with a relatively large area, which area occupies more than about 50 percent of the bottom portion of the container, and more preferably which area occupies at least about 60 percent of the bottom portion of the container.

In some preferred cases, the tabs project outwardly from the perimeter of the container a distance of from about 0.15 to about 0.25 times the characteristic diameter of the container; for example, in one typical embodiment in the form of a plate, the first and second tabs extend outwardly from the perimeter of the container a distance of about 0.15 times the diameter, D, of the container and the outer flange portion of the container is an arcuate outer flange portion with a convex upper surface, the radius of curvature of the arcuate outer flange portion being between about 0.0175 and about 0.1 times the characteristic diameter of the container. The container is further characterized by a flange outer vertical drop wherein the ratio of the flange outer vertical drop to the characteristic diameter of the container is greater than about 0.01. The container may be provided with a third and fourth peripheral tab if so desired. For example, the container may have a generally round shape such that the container perimeter is a circle having a diameter, D, and the first cross-tab dimension defined by the first and second peripheral tabs is generally equal in length to the diameter, D, and wherein the third and fourth peripheral tabs are generally planar and extend outwardly from the flange portion of the container, most preferably in a direction generally parallel to the planar bottom portion of the container and are configured to define a second cross-tab dimension between their outer edges generally parallel to and of like extent with the first cross-tab dimension defined by the first and second peripheral tabs. One or all of the peripheral tabs may be provided with a printed image.

Generally speaking, the tabs may have an arcuate outer edge with a radius of curvature of from about 0.01 to about 0.4 times the characteristic diameter of the container; from about 0.05 to about 0.35 times the characteristic diameter of the container is somewhat typical. The first and second peripheral tabs may have an arcuate outer edge with a radius of curvature of from about 0.1 to about 0.35 times the characteristic diameter of the container. From about 0.15 to about 0.35 times the characteristic diameter of the container is preferred in some cases.

The peripheral tabs generally define an included angle therebetween of less than 150°, typically less than 120° and preferably from about 70° to 90°.

As noted, the inventive containers may be formed of paper, for example press-formed from a paperboard blank wherein at least one surface of said paperboard blank is provided with a substantially liquid-impervious coating comprising an inorganic pigment or filler and a water-based, press applied overcoat. At least one surface of the paperboard blank may be provided with a styrene-butadiene polymer coating such as a carboxylated styrene-butadiene polymer. As an alternative to a pressed paperboard container, a pulp molded container may be utilized. The pulp molded container could be post-form printed, or laminated with a printed film, for example.

The inventive container may be formed of a thermoplastic composition by way of a technique selected from the group consisting of injection molding, injection blow molding, injection stretch molding and composite injection molding. Suitable materials include a foamed polymeric material, or sheet stock of thermoplastic material. Thermoforming may be by the application of vacuum or by a combination of vacuum and pressure. Suitable polymeric materials include foamed or solid polymeric material selected from the group consisting of: polyamides, polyacrylates, polysulfones, polyetherketones, polycarbonates, acrylics, polyphenylene sulfides, acetals, cellulosic polymers, polyetherimides, polyphenylene ethers or oxides, styrene-maleic anhydride copolymers, styrene-acrylonitrile copolymers, polyvinylchlorides and mixtures thereof. Especially preferred are materials selected from the group consisting of: polyesters, polystyrenes, polypropylenes, polyethylenes and mixtures thereof, such as mineral-filled polypropylene sheet stock wherein said mineral filler is predominantly mica.

A typical plastic container may thus have a wall thickness form about 10 to about 80 mils and consist essentially of from about 40 to about 90 percent by weight of a polypropylene polymer, from about 10 to about 60 percent by weight of a mineral filler, from about 1 to about 15 percent by weight polyethylene, up to about 5 weight percent titanium dioxide and optionally including a basic organic or basic inorganic compound comprising the reaction product of an alkali metal or alkaline earth element with carbonates, phosphates, carboxylic acids as well as alkali metal and alkaline earth element oxides, hydroxides, or silicates and basic metal oxides, including mixtures of silicon dioxide with one or more of the following oxides: magnesium oxide, calcium oxide, barium oxide, and mixtures thereof. In such containers a typical wall caliper of from about 10 to about 50 mils, and preferably from about 15 to about 25 mils.

A preferred disposable servingware container has a generally round shape, is press-formed from a generally planar paperboard blank and includes: a generally planar bottom portion; a first annular transition portion extending upwardly and outwardly from the generally planar bottom portion; an optional sidewall portion extending upwardly and outwardly from the first annular transition portion; a second annular transition portion flaring outwardly with respect to the first annular transition; and an outer flange portion extending outwardly with respect to the second annular transition portion defining a generally circular container perimeter having a diameter, D. There is further provided at least first and second generally planar peripheral tabs extending outwardly from the flange portion of the container generally beyond the container perimeter, most preferably in a direction generally parallel to the generally planar bottom portion of the container, the peripheral tabs being configured so as to define a cross-tab dimension between their outer edges of generally equal length with diameter, D. In preferred embodiments, some or all of the sidewall portion, the second annular transition portion and the outer flange are provided with a plurality of circumferentially spaced, radially extending regions formed from a plurality of paperboard lamellae rebonded into substantially integrated fibrous structures generally inseparable into their constituent lamellae. These regions preferably extend over a profile distance corresponding to at least a portion of the length of the scores of the paperboard blank from which the container is formed. Typically, the rebonded paperboard regions extend over some or all of the length of a pleat in the container. In particularly preferred embodiments, the rebonded paperboard regions form an array in an annular region corresponding to at least a part of the profile of at least one of the second annular transition regions, the optional sidewall or the outer flange. Still more preferably, the region including rebonded paperboard lamellae are generally of the same thickness as adjacent areas of the container.

A preferred embodiment is in the form of a disposable plate having a caliper of at least about 10 mils, and typically having a caliper of at least about 12 mils. More preferably, in some case, the container has a caliper of at least about 15 mils and being provided with a coating comprising a clay filler. Generally a caliper range of from about 10 to about 25 mils is employed in connection with paperboard containers with about 12 to about 22.5 mils being typical.Containers of the invention may be made in the form of a compartmented plate with 2 or more, typically 3 serving sections wherein the plate has an arcuate outer flange which has a radius or curvature of the flange which is greater than about 0.025 times the characteristic diameter of the container; typically, the radius of curvature is from about 0.035 to about 0.07 times the characteristic diameter of the container. At least 2 of the serving sections and/or the tabs may be provided with predetermined portions of a printed image which may include character attributes, such as facial features including eyes, noses, whiskers, mouths and the like and the tabs may be provided with printed representations of the same or other attributes such as "ears", "fins", "arms", "paws", "hands", "hair", "feet" and the like as will be appreciated from the Figures. Other features might include claws, antennae and elements of the creatures surrounding environment.The printed image could contain text for entertaining children such as trivia, including animal facts relating to the graphics, games and so forth. Any of the character attributes could be printed on any portion of the container or paperboard blank as described and illustrated in the Figures.The bottom portion of the container is optionally provided with embossments or debossments which may correspond with printed character attributes. For example, the bottom could be provided with two "bubble" type debossments printed with eyes, or with curved or linear debossed lines printed with corresponding images. The convex upper surface of the arcuate outer flange portion is generally configured so that it defines its radius of curvature over an included angle of from about 30° to about 80°, typically the convex upper surface of the arcuate outer flange portion is configured so that it defines its radius of curvature over an included angle of from about 50° to about 75°. The plate may be further characterized by a flange outer vertical drop wherein the ratio of the flange outer vertical drop to the characteristic diameter of the container is greater than about 0.01 Generally, the ratio of the flange outer vertical drop to the diameter, D,of the container is greater than about 0.013 and typically the ratio of the flange outer vertical drop to the diameter, D, of the container is greater than about 0.015. Preferably, the ratio of the flange outer vertical drop to the diameter, D, for the container is greater than about 0.0175.

In another aspect of the invention, there is provided a disposable servingware container press-formed from a paperboard blank provided with a generally planar bottom portion; a first annular transition portion extending upwardly and outwardly from the generally planar bottom portion; an optional sidewall portion extending upwardly and outwardly with respect to the first annular transition portion; a second annular transition portion flaring outwardly with respect to the first annular transition portion; an outer flange portion extending outwardly with respect to the second annular transition portion defining generally the container perimeter having a characteristic diameter, D, and the container has a height, H; the outer flange portion being characterized by a vertical drop wherein the ratio of the flange outer vertical drop to the characteristic diameter o the container is greater than bout 0.01 such that the outer edge of the container terminates below the height, H, of the container generally at a brim height, $H_b$; and a generally planar peripheral tab extends outwardly from the flange portion of the container in a direction generally parallel to the generally bottom portion of the container over a distance of at least about 0.02 times the characteristic diameter of the container. The tab may extend outwardly a distance of from about 0.02 to about 0.3 times the characteristic diameter of the container, whereas the tab typically extends outwardly a distance of from about 0.1 to about 0.3 times the characteristic diameter of the container (from 0.15 to 0.25 being somewhat typical) and has generally the characteristics of the tabs described above when 2 tabs are employed. The shape and characteristics of the container may otherwise be the same as other embodiments. As will be seen in the drawings, the peripheral tab typically extends outward at a tab height, $H_T$ which is less than the brim height, $H_b$.

The inventive containers are perhaps most preferably prepared from a generally planar paperboard blank suitable for press-forming into a disposable pressware container with a central portion defining generally a perimeter thereof having a characteristic diameter and at least first and second peripheral tabs extending outwardly from the central portion beyond the perimeter of the central portion, the peripheral tabs being configured so as to define a cross-tab dimension between their outer edges generally parallel to and of like extent with a corresponding transverse dimension across the perimeter of the central portion of the blank.

In a typical embodiment, the central portion of the blank has a circular shape defining a diameter, D', and the cross-tab dimension defined by the first and second peripheral tabs is generally equal in length to the diameter, D'. The first and second peripheral tabs have an arcuate outer edge wherein the outer edges of the first and second peripheral tabs have a radius of curvature of generally from about 0.01 to about 0.4 times the characteristic diameter of the paperboard blank and in some cases from about 0.05 to about 0.35 or more specifically from 0.1 to about 0.35 times the diameter, D', of the paperboard blank. There is shown embodiments wherein the peripheral tabs have a radius of curvature of from about 0.15 to about 0.35 times the diameter, D', of the paperboard blank. Generally, the first and second peripheral tabs extend beyond the perimeter of the central portion of the paperboard blank a distance of from about 0.02 to about 0.3 times the characteristic diameter of the central portion and the blank is scored about its perimeter, while the first and second peripheral tabs are typically unscored. Extension distances of from about 0.1 to about 0.3 times the characteristic diameter of the blank are typical.

The paperboard blank may be scored or unscored or scored in part, have a caliper of at least about 10 mils, generally it has a caliper of at least about 12 mils. The peripheral tabs are preferably unscored. In some cases, the blank has a caliper of at least about 15 mils and provided with a coating including a clay filler. A caliper range of from about 10 to about 25 mils is typical, preferably the caliper of from about 12 to about 22.5. The blank may be provided with a printed image wherein the printed image comprises facial features or other character attributes as noted above.

Typically, the tabs are offset from one another by an included angle which is less than about 150° as discussed above as well as later in this patent.

In some cases, the paperboard blank further includes third and fourth peripheral tabs extending outwardly from the central portion beyond the perimeter of the central portion, wherein the third and fourth peripheral tabs are configured so as to define a second cross-tab dimension between their outer edges generally parallel to and of like extent with the corresponding transverse dimension across the perimeter of the blank. The blank has a round perimeter in many cases and the cross-tab dimension is equal to the diameter of the blank.

In a further embodiment, there is provided a generally planar paperboard blank suitable for press-forming into a disposable pressware container comprising: a central portion defining generally a perimeter thereof having a characteristic diameter; first and second peripheral tabs extending outwardly from the central portion beyond the perimeter of the central portion, the first and second peripheral tabs being configured so as to define a first cross-tab dimension between their outer edges generally parallel to and of greater length than a corresponding transverse dimension across the perimeter of the blank; third and fourth peripheral tabs extending outwardly from the central portion beyond the perimeter of the central portion, the third and fourth peripheral tabs being configured so as to define a second cross-tab dimension between their outer edges generally parallel to and of greater length than the corresponding transverse dimension across the perimeter of the blank; and wherein the first and second cross-tab dimensions are generally equal in length. In a preferred embodiment the central portion of the blank is circular and defines a diameter, D', and the first and second cross-tab dimensions are greater than the diameter, D', and equal in length to each other.

In still yet another further aspect of the present invention, there is provided a method of press-forming a paperboard blank into a disposable servingware container including the steps of: (a) providing a generally planar paperboard blank which includes a central portion defining generally a perimeter thereof as well as at least a first and second peripheral tabs extending outwardly from the central portion beyond the perimeter of the central portion, the peripheral tabs being configured so as to define a cross-tab dimension between their outer edges generally parallel to and of like extent with a corresponding transverse dimension across the paperboard blank perimeter; (b) transferring the paperboard blank to a die set while controlling its orientation utilizing the first and second peripheral tabs such that the paperboard blank is disposed in the die set in a predetermined orientation with respect thereto; and (c) press-forming said paperboard blank into a disposable container having a generally planar bottom portion; a first annular transition portion extending upwardly and outwardly from the generally planar bottom portion; an optional sidewall portion extending upwardly and outwardly from the first annular transition portion; a second annular transition portion flaring outwardly with respect to the first annular portion; and outer flange portion flaring outwardly with respect to the second annular transition portion defining generally the container perimeter; and at least first and second generally planar peripheral tabs corresponding to the tabs of the paperboard blank extending outwardly from the flange portion of the container generally beyond the container perimeter, preferably in a direction generally parallel to the generally planar bottom portion of the container. Preferably, the peripheral tabs being configured so as to define a first cross-tab dimension between their outer edges generally parallel to and of like extent with a corresponding transverse dimension across the perimeter of the container.

In some cases, the central portion of the paperboard blank is circular and defines a diameter, D', and the first cross-tab dimension defined by the first and second peripheral tabs is generally equal in length to the diameter, D', of the central portion of the paperboard blank. In still other embodiments, the paperboard blank further comprises third and fourth peripheral tabs extending outwardly from the central portion beyond the perimeter of the central portion wherein the third and fourth peripheral tabs are configured so as to define a second cross-tab dimension between their outer edges generally parallel to and of like extent with the corresponding transverse dimension across the perimeter of the blank.

Typically, the step of transferring the paperboard blank to die set includes guiding the paperboard blank with a pair of generally parallel opposed tracks, and the paperboard blank is provided with a printed image of predetermined position with respect to the peripheral tabs of the paperboard blank. So also, the step of forming the container may include forming a plurality of ribs into the bottom portion of the container in predetermined correspondence with the printed image of the paperboard blank, which is particularly advantageous when the image comprises character attributes such as facial features or other character attributes as noted herein.

The step of forming the container may include forming a plurality of embossments or debossments into the bottom portion of the container in predetermined correspondence with the printed image on the paperboard blank; the image may have character attributes selected from the group consisting of feet, noses and eyes, and the like such as noted above.

Generally, the inventive method is practiced with a segmented die set, for example the die set might include a punch with a punch base member provided with a punch outer container contour portion, a punch knock-out mounted for reciprocating motion with respect to the punch base member and a pressure ring mounted for reciprocating motion with respect to the punch base member, as well as a die with a die base member with a die outer container contour portion, a die knock-out mounted for reciprocating motion with respect to the die base member and a draw ring mounted for reciprocating motion with respect to the die base member. Each of the various parts may be formed of a single piece or multiple sections if so desired. Typically, the paperboard blank contacts the draw ring and the pressure ring during closure of the die set prior to contacting both of the outer container contour portions of the punch base and die base. The paperboard blank also contacts the die knock-out and the punch knock-out prior to contacting the punch base and die base outer container contour portions. In a preferred aspect illustrated hereinafter, the die knock-out has a generally planar surface provided with a plurality of cantilevered male rib portions projecting therefrom and the punch knock-out is provided with a generally planar surface having a plurality of female grooves therein corresponding to the male rib portions of the die knock-out adapted to cooperate therewith to form a plurality of ribs in the bottom portion of the disposable servingware container upon press-forming thereof from a paperboard blank.

In still yet further embodiments, there is provided a disposable servingware container comprising: a generally planar bottom portion; a first annular transition portion extending upwardly and outwardly from the generally planar bottom portion; an optional sidewall portion extending upwardly and outwardly from the first annular transition portion; a second annular transition portion flaring outwardly with respect to the first annular transition portion; an outer flange portion extending outwardly with respect to the second annular transition portion defining generally the container perimeter having a characteristic diameter; and first and second generally planar peripheral tabs extending outwardly from the flange portion of the container generally beyond the container perimeter, most preferably in a direction generally parallel to the generally planar bottom portion of the container, the first and second peripheral tabs being configured so as to define a first cross-tab dimension between their outer edges generally parallel to and of greater length than with a corresponding transverse dimension across the perimeter of the container. Here again, the container perimeter is preferably circular and defines a diameter, D, and the first cross-tab dimensions are of a length greater than D. The container may be formed as a bowl having a height to diameter ratio of at least 0.15, and more specifically having a height to diameter ratio of from about 0.175 to about 0.3.

A four-tab embodiment is a disposable servingware container comprising: a generally planar bottom portion; a first annular transition portion extending upwardly and outwardly from the generally planar bottom portion; an optional sidewall portion extending upwardly and outwardly from the first annular transition portion; a second annular transition portion flaring outwardly with respect to the first annular transition portion; an outer flange portion extending outwardly with respect to the second annular transition portion defining generally the container perimeter having a characteristic diameter; first and second generally planar peripheral tabs extending outwardly from the flange portion of the container generally beyond the container perimeter, preferably in a direction generally parallel to the generally planar bottom portion of the container, the first and second peripheral tabs being configured so as to define a first cross-tab dimension between their outer edges generally parallel to and of greater length than with a corresponding transverse dimension across the perimeter of the container; and third and fourth generally planar peripheral tabs extending outwardly from the flange portion of the container generally beyond the container perimeter, preferably in a direction generally parallel to the generally planar bottom portion of the container, the third and fourth peripheral tabs being configured so as to define a second cross-tab dimension between their outer edges generally parallel to and of greater length than with a corresponding transverse dimension across the perimeter of the container. The container perimeter is also preferably circular and defines a diameter, D, and the first and second cross-tab dimensions are generally equal in length and of a length greater than D. The product may be formed as a bowl having a height to diameter ratio of at least 0.15, such as from about 0.175 to about 0.3.

Still yet another aspect involves a method of making a disposable container comprising: (a) preparing a paperboard blank with a circular perimeter of diameter, D', and first and second peripheral lobular tabs extending outwardly from the perimeter of diameter, D', of the paperboard blank; (b) press-forming the paperboard blank into a disposable container having a generally planar bottom portion, a first annular transition portion adjacent thereto extending to an optional sidewall portion, a second annular transition portion preferably at the upper edge of the sidewall and an outer flange extending outwardly from the second annular transition portion to define the bowl diameter, D, which is less than D', wherein the container has a height to diameter ratio of greater than about 0.1; and wherein further the lobular tabs extend outwardly from the bowl perimeter of diameter D a distance of from about 0.02 to about 0.3 times the bowl diameter, D, preferably in a direction generally parallel with the planar bottom portion of the bowl. The bowl may have a height to diameter ratio of greater than about 0.125 or 0.15, typically in the range from about 0.175 to about 0.3, such as a height to diameter ratio of from about 0.2 to about 0.275. In some cases the lobular tabs extend outwardly from the bowl perimeter a distance of from about 0.1 to about 0.3 times the diameter, D, of the container such as from about 0.15 to about 0.25 times the bowl diameter, D, preferably in a direction generally parallel with the planar bottom portion of the bowl and preferably the paperboard blank is provided with a printed image of predetermined position with respect to the lobular tabs of the paperboard blank. The image comprises character attributes which are optionally facial features or other character attributes, for example, selected form the group consisting of eyes, ears, fins, arms, paws, hands, hair, legs or feet applied to said tabs. The step of forming the container may in some cases include forming a plurality of embossments or debossments into the bottom portion of the container in predetermined correspondence with the printed image on the paperboard blank.

Generally, bowls and deep dish containers have height to diameter ratios of greater than 0.1 while plates have height to diameter ratios of less than 0.1.

When making bowls by the inventive method, preferably the paperboard blank has at least about 40 radially extending scores spread around its perimeter and more preferably at least about 60 or perhaps 75 radially extending scores spread around its perimeter. The first and second tabs define an angle therebetween less than about 150°, preferably less than about 120°. Typically, the first and second peripheral tabs define an angle therebetween of from about 70° to about 90°. The lobular tabs may be planar or of any suitable geometry. The term lobular simply refers to a roundish projection from the perimeter of the container.

The foregoing and other features of the invention will become apparent from the discussion which follows.

BRIEF DESCRIPTION OF DRAWINGS

The invention is described in detail below with reference to the various Figures, wherein like numbers designate similar parts and wherein.

DETAILED DESCRIPTION

Figure 1:
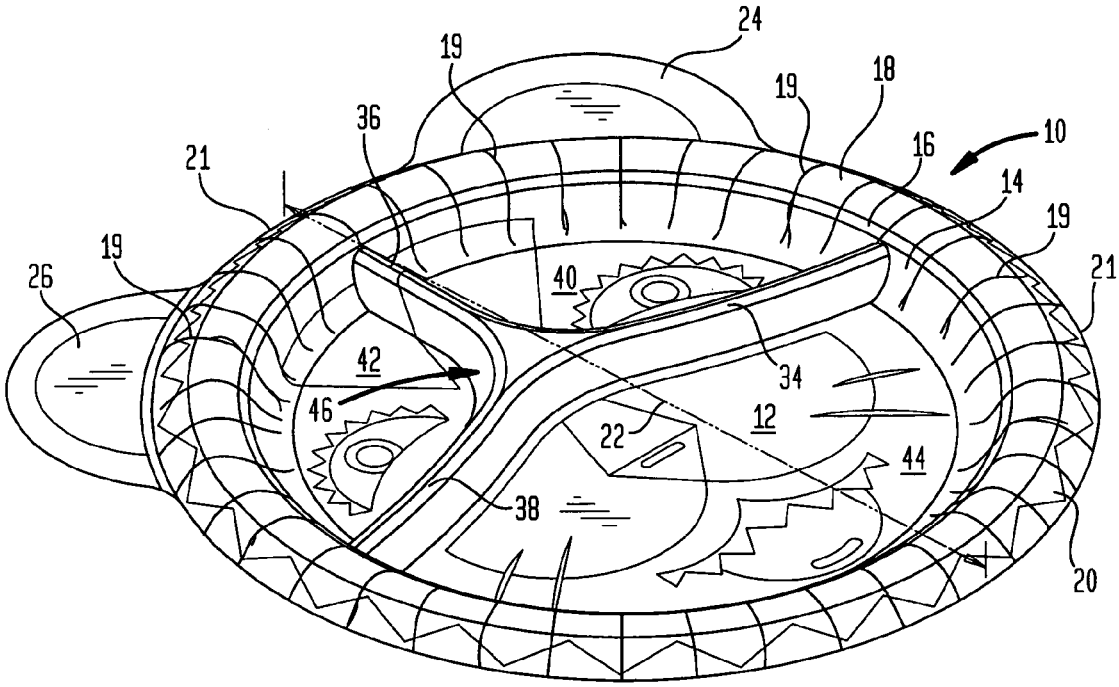
FIG. 1 is a view in perspective of a disposable paper plate configured in accordance with the present invention.

The invention is described in detail below with reference to numerous embodiments for purposes of exemplification and illustration only. Modifications to particular embodiments within the spirit and scope of the present invention, set forth in the appended claims, will be readily apparent to those of skill in the art.

As used herein, terminology is given its ordinary meaning unless a more specific definition is given or the context indicates otherwise. Disposable containers of the present invention generally have a characteristic diameter. For circular bowls, plates, platters and the like, the characteristic diameter is simply the outer diameter of the product. For other shapes, an average diameter can be used; for example, the arithmetic average of the major and minor axes could be used for elliptical shapes, whereas the average length of the sides of a rectangular shape is used as the characteristic diameter and so forth. Sheet stock refers to both a web or roll of material and to material that is cut into sheet form for processing. Unless otherwise indicated, "mil", "mils" and like terminology refers to thousandths of an inch and dimensions appear in inches. Likewise, caliper is the thickness of material and is expressed in mils unless otherwise specified. The term major component, predominant component and the like refers to a component making up at least about 50% of a composition or that class of compound in the composition by weight as the context indicates; for example, a filler is the predominant filler in a filled plastic composition if it makes up more than about 50% by weight of the filler in the composition based on the combined weigh of filler in the composition. The arcuate outer flange of containers of the present invention is preferably characterized by a smooth, flowing outer profile as described and illustrated herein. That outer profile may define a single radius of curvature such as R4 in FIG. 14 for arcuate outer profiles of constant curvature. In embodiments where the arcuate outer profile has a plurality of characteristic radii, for example, if the profile is somewhat in the nature of spiral or elliptical in shape, a weighted mean curvature may be used, the radius of curvature being the reciprocal of curvature. In embodiments where the arcuate outer profile has a plurality of characteristic radii, for example, if the profile is somewhat in the nature of spiral or elliptical in shape, a weighted mean curvature may be used, the radius of curvature being the reciprocal of curvature. Such geometry may arise, for example, when the container is formed in a die set having a contour corresponding to the outer arcuate flange of the container with a single radius of curvature in that region and the product, after forming, relaxes slightly in some areas more than others. In cases where a somewhat segmented arcuate outer flange is employed, one may simply approximate the corresponding arcuate shape to determine the mean curvature (which may be a weighted mean curvature as noted above).

SSI rigidity is measured with the Single Service Institute Plate Rigidity Tester of the type originally available through Single Service Institute, 1025 Connecticut Ave., N.W., Washington, D.C. The SSI rigidity test apparatus has been manufactured and sold through Sherwood Tool, Inc., Kensington, Conn. This test is designed to measure the rigidity (i.e., resistance to buckling and bending) of paper and plastic plates, bowls, dishes, and trays by measuring the force required to deflect the rim of these products a distance of 0.5 inch while the product is supported at its geometric center. Specifically, the plate specimen is restrained by an adjustable bar on one side and is center supported. The rim or flange side opposite to the restrained side is subjected to 0.5 inch deflection by means of a motorized cam assembly equipped with a load cell, and the force (grams) is recorded. The test simulates in many respects the performance of a container as it is held in the hand of a consumer, supporting the weight of the container's contents. SSI rigidity is expressed as grams per 0.5 inch deflection. A higher SSI value is desirable since this indicates a more rigid product. All measurements were done at standard TAPPI conditions for paperboard testing, 72° F. and 50% relative humidity. Geometric mean averages (square root of the MD/CD product) as well as the machine direction (MD) values and cross machine direction (CD) values are reported herein.

The particular apparatus employed for SSI rigidity measurements was a Model No. ML-4431-2 SSI rigidity tester as modified by Georgia-Pacific Corporation, National Quality Assurance Lab, Lehigh Valley Plant, Easton, Pa. 18040 using a Chatillon gauge available from Chatillon, Force Measurements Division, P.O. Box 35668, Greensboro, N.C. 27425-5668.

Disposable servingware containers such as pressware paperboard containers typically are in the form of plates, both compartmented and non-compartmented, as well as bowls, trays, and platters. The products are typically round or oval in shape but can also be hexagonal, octagonal, or multi-sided.

Compartmented pressware plates are typically more difficult to form than non-compartmented pressware plates since a blank typically is scored (often with a specialized pattern) and drawn into the final shape over and between the ribs of the forming die without ripping or tearing due to exceeding material stretch limits. Blank orientation with the score pattern is often required. Post trimming of the formed product is also often necessary to obtain a uniform outer edge due to the differential draw of the paperboard into the irregular shape. Alternatively, intricate two-step trim and form tooling is necessary to obtain a uniform outer edge with an irregular shape. Round blanks commonly rotate somewhat between blanking and forming in the transfer chutes, thus making controllable registration of a print design, scoring pattern and plate compartmented regions impossible in conventional systems.

Lower dividers for paper compartmented plates tend to be easier to form without material degradation. So also, a curvy outer plate profile is more forgiving during the forming process. A suitable technique for forming compartmented plates in accordance with the present invention includes using a die with a knock-out provided with ribs that cantilever slightly outward over the die contour and profile. The punch ribs are machined into an articulated style knock-out as well. The significance of these features and their application will be apparent from the Figures and the discussion which follows. Briefly, the material available in the profile portion of the articulated punch knock-out determines the maximum height of the compartmented ribs. During closing of the tooling, pressure and draw rings contact first providing a clamping area to control paperboard gathering and pleating. The upper and lower knock-outs with the dividers machined into them then contact the paper holding the blank on center and perform the compartments prior to forming the outer plate profile. The articulated punch knock-out is spaced downward slightly (0.030" to 0.150") from the punch base contour portion to ensure that the paperboard is fully drawn to the bottom of the die set during the forming operation, thus pre-forming the bottom. As the tooling closes, the upper and lower knock-outs retract until the full press force is applied to finalize the product formation into the profile and rib areas.

Bowls, due to their relatively deep draw, are also more difficult to form than non-compartmented plates. Typical problems involve off-center forming, pleating control, material tearing and so forth. It has been unexpectedly found in accordance with the present invention that rigid bowls may be readily prepared at production speeds using tabbed paperboard blanks.

The present invention is particularly directed to a disposable servingware product having tabs that continue outward beyond the nominal product diameter or outer edge in one or more locations around the product perimeter. The tabs continue past the product outer edge in a substantially horizontal manner as shown in the various Figures, but may be oriented slightly upward or downward ±20° with respect to a horizontal either by design or due to material "springback", for example. The tabs may be added for ease of product separation and/or may also be printed to represent character attributes such as "ears", "fins", "feet", "arms", and so forth. The main product body may also be printed in appealing designs for children's plates, bowls and trays. Animals, action figures, cartoon characters, collectibles, or other themes may be incorporated into the pressware product with tabs. The plates may be compartmented in the manner shown to provide utility and further accent the print design with the compartments representing eyes, mouths, and so forth. The blank can be designed in such a manner that the tabs and nominal diameter are "in-line" to make transfer to and into the forming tooling controllable for registration with printing. A web forming method can also be used and no post trimming is required to obtain the final desired product. The width of the formed tabs is preferably approximately the same as the product diameter (width) so that the formed product can be more controllably stacked, conveyed and packaged as will be appreciated by one of skill in the art.

The present invention typically employs a segmented dies generally as is known and further discussed herein. Several compartmented rib designs are shown which are typically provided with a relatively low rib height (typically ¼ inch or so). Higher ribs may be used but are typically more difficult to form without material tearing or pleating issues. Moreover, scoring patterns bad been developed and trialed wherein it has been found that evenly spaced scores are preferred for the various rib layouts illustrated. It should be noted that the scoring pattern does not extend through the tab areas. The termination of the scoring and clamping action described below is preferred since it limits propagation of pleats and folds into the tab areas of the formed product that could detract from the printing aesthetics in these areas. Generally speaking, the present invention is directed to a pressware product with one or more tabs that extend beyond the nominal product diameter or outer edge in a substantially horizontal manner for separation tabs, or for printing or to generally enhance the aesthetics of the product. Formation of a pressware product with one or more tabs using a die set equipped with pressure and draw rings contribute to pleating control and provide the final pressing and shape to the tabs. The blank used to form the pressware product with tabs is designed such that the width across the tabs in the nominal blank diameter are approximately the same and in line to make blank transfer to and into forming tooling controllable for registration with printing (and compartments if applicable). Scoring that extends to but not into the tab areas limits the propagation of pleats and folds in the tab areas formed on the product. Most preferably, the formed product has tabs extending past the nominal diameter such that the width across the tabs is approximately the same as the product diameter across the other portions of the product so that the product is more readily stacked, conveyed and packaged. Formation of a compartmented pressware product with tabs in a relatively uniform outer edge using a web feed forming operation typically does not require post trimming.

Optionally, pulp molded products may be provided with post-form printing or laminated with a printed film as noted above.

The inventive containers may be made by injection molding, thermoforming and so forth; however, manufacture from paperboard is preferred. Clay coated paperboard is typically printed, coated with a functional grease/water resistant barrier and moistened prior to blanking and forming. The printed, coated and moistened paperboard roll is then transferred to a web feed blanking press where the blanks with tabs are cut in a straight across, staggered, or nested pattern (to minimize scrap). The blanks are transferred to the multi-up forming tool via individual transfer chutes. Typically, blanks with tabs can not be nested as tightly together as round blanks without tabs and typically must have separate channels in the blanking die to ensure efficient and consistent transfer. As a result, the number of blanking and forming positions for round blanks with tabs may be less than for round blanks without tabs as determined by a maximum web or forming press width. A 9.375 inch diameter round blank, for example, may be blanked and formed 5 across with a nominal 43 inch web width in a 57 inch wide pressware machine, whereas a 9.375 inch diameter round blank with tabs only may be blanked and formed 4 across on the same machine. Two tabs with approximately the same width as the nominal blank diameter can be more readily and accurately guided down a transfer chute into a die set that has edge guide clearances slightly wider (0.01 to 0.040 inches) than the blank diameter. The blank will commonly hit against blank stops (rigid or pin stops that can rotate) for final positioning prior to forming. The stop heights and locations are chosen to accurately locate the blank and allow the formed product to be removed from the tooling without interference. Typically the forward portions of the blank stops are lower in height since the formed product must pass over them. That is to say, the stops may contact the main blank diameter, but it may also be possible to configure the tabs of a paperboard blank of the present invention so that they contact the stops and accurately locate the blank. Additionally, a stop system may be used that extends upward to locate the blank and then retracts after final formation so as not to interfere with product removal, or the forward portion of the edge guide can be shaped to catch tabs in the case of a four-tab blank or where a tab is otherwise oriented to a forward position.

Instead of web forming, blanks could be rotary cut or reciprocally cut off-line in a separate operation. The blanks could be transferred to the forming tooling via transfer chutes using a blank feed style press. The overall productivity of a blank feed style press is typically lower than a web feed style press since the stacks of blanks must be continually inserted into the feed section, the presses are commonly narrow in width with fewer forming positions available and the forming speeds are commonly less since fluid hydraulics are typically used versus mechanical cams and gears.

As noted, the blank is positioned by rigid or rotating pin stops as well as by side edge guides that contact the nominal blank diameter and tab widths. The punch pressure ring contacts the blank, clamping it against the lower draw ring and optional relief area to provide initial pleating control. The upper punch and lower die knock-outs (that may have compartment ribs machined into them) then contact the paperboard holding the blank on center and preform the compartmented dividers. The upper knock-out is typically of an articulated style having spring pre-load and full loads and 0.030 inch to 0.120 inch articulation stroke during the formation. The pressure ring has the outer product profile machined into it and provides further pleating control by clamping the blank between its profile area and die outer profile during the formation. The draw ring and pressure rings springs typically are chosen in the manner to allow full movement of the draw ring prior to pressure ring movement (i.e., full spring force of draw ring is less than or equal to the pre-load of the pressure ring springs). The articulated punch knock-out ensures that the product bottom and compartment dividers are fully formed prior to final formation of the sidewall, flange and downturn areas. The various features of the manufacturing process are perhaps better understood by first considering the inventive containers per se.

Referring generally to FIGS. 1-5, 13 and 14, there is illustrated a disposable plate 10 configured in accordance with the present invention. Plate 10 includes a generally planar bottom portion 12 which may be provided with a slight crown if so desired as is well known in the art. Bottom portion 12 extends outwardly to a first annular transition portion 14 which extends upwardly and outwardly from generally planar bottom portion 12 to a sidewall portion 16. Sidewall portion 16 likewise extends upwardly and outwardly from first annular transition portion 14 to a second annular transition portion 18. Second annular transition portion 18 transitions to an outer flange portion 20 which defines the plate perimeter 21.

Figure 2:
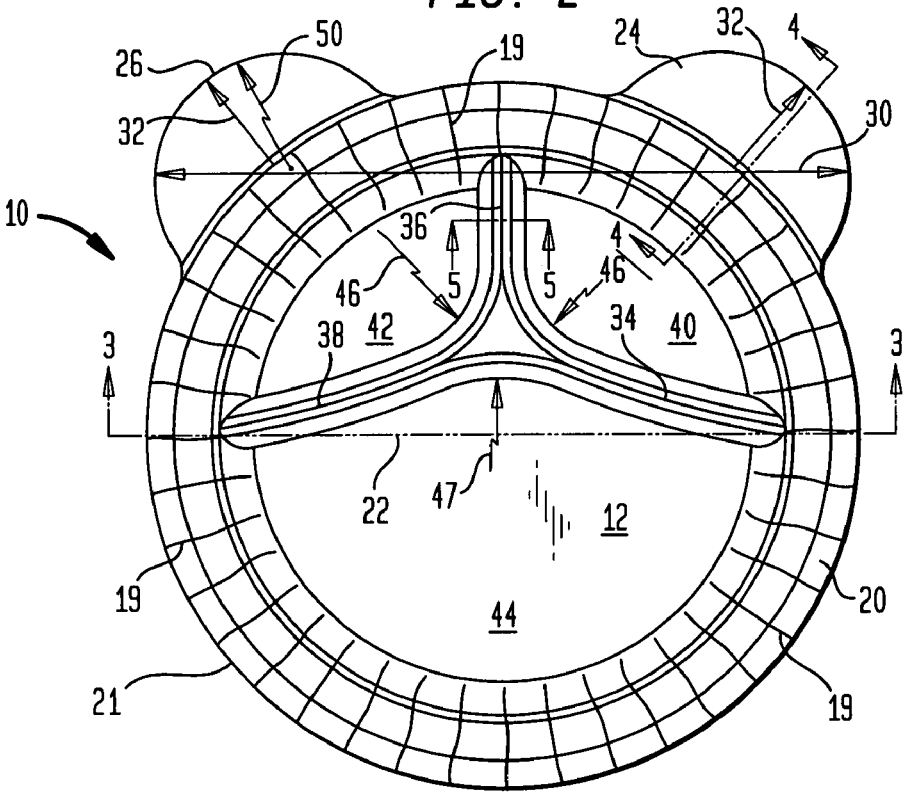
FIG. 2 is a plan view of the disposable paper plate of FIG. 1.
Figure 3:
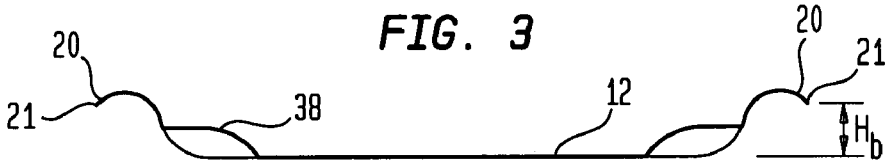
FIG. 3 is a schematic section view at line 3-3 of FIG. 2.

There is shown in FIGS. 1 and 2 a plurality of pleats such as pleats 19 provided every 9° or so about the perimeter.

These pleats correspond to scores in the paperboard blank as discussed hereinafter. Pleats are omitted on other Figures (in whole or in part) for purposes of illustration but are present when the inventive containers are press-formed from a paperboard blank. Generally, the pleats extend from the bottom of the container to the perimeter of the container, but do not extend from the perimeter over the tabs as such. That is to say, while some pleating occurs on the tabs and provides desirable texture in some cases, pleating is much more prevalent inwardly of the tabs where there is more excess paperboard.

Perimeter 21 has a characteristic diameter 22 which in the case of a round plate as shown in FIGS. 1 through 5, is simply the diameter of the plate. First and second peripheral tabs, 24 and 26 extend outwardly from flange 20 in a generally horizontal direction 28 (FIG. 4) typically within ±10° with respect to a horizontal. The tabs define a cross-tab dimension 30 which is about equal to diameter 22. The tabs may extend outwardly from the perimeter of the container a distance 32 which is typically from about 0.02 to about 0.3 times diameter 22 of the container. Distance 32 is the maximum distance the tab projects from the perimeter.

Figure 4:
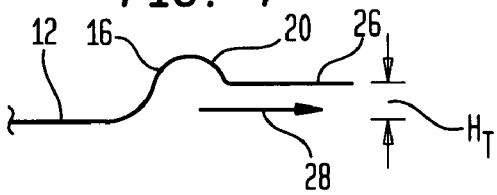
FIG. 4 is a partial view in section of the paper plate of FIG. 1 and along line 4-4 of FIG. 2.
Figure 5:
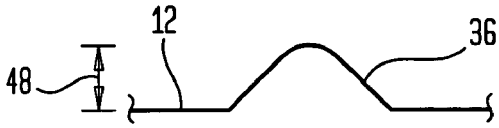
FIG. 5 is a partial sectional view of the disposable paper plate of FIGS. 1 and 2 along 5-5 of FIG. 2 illustrating the profile of a divider rib.
Figure 14:
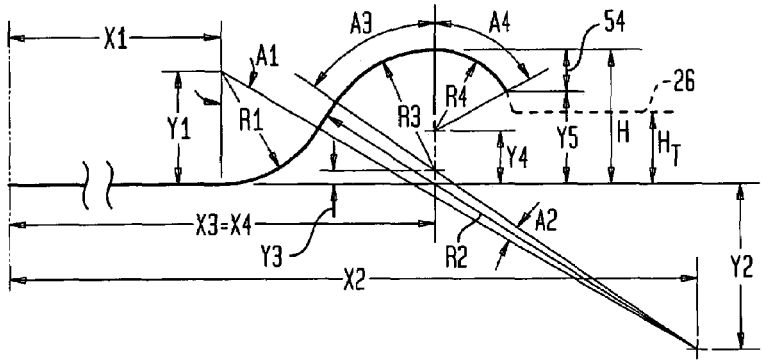
FIG. 14 is a schematic diagram illustrating in more detail the profile of FIG. 13 and shows the profile extension along a tab with a dotted line.

There is shown in FIG. 14 a schematic diagram illustrating in more detail of preferred profiles for making paper pressware products in accordance with the present invention. In general, this profile is disclosed in U.S. Pat. No. 5,088,640, the disclosure of which is incorporated by reference. The profile includes four distinct curved portions defining radii of curvature R1 through R4 as shown in FIG. 14. Radius R1 has its origin at a distance X1 from the center of the container at a height Y1 from the bottom of the container. Radius R2 has its origin at a distance X2 from the center of the container at a distance Y2 below the bottom of the container, while both radii R3 and R4 have their origins at a distance X3 which is equal to X4 from the center of the container and their heights at distances Y3 and Y4 from the bottom of the container respectively. The tabs extend outwardly in a generally parallel direction with the bottom of the container at a height, $H_T$, as shown in FIGS. 4 and 14. As used herein with respect to the tabs, "generally parallel" to the bottom of the container and like terminology means in a direction ± about 20 degrees from parallel with the plane defined generally by the bottom of the container. The profile extension from the brim along tab 26 is shown in dotted lines in FIG. 14. The plate profile at the product perimeter terminates at a height Y5 sometimes referred to herein as the brim height, $H_b$, which is less than the height, H, of the container. $H_T$, the tab height, in turn, is generally less than the brim height, $H_b$. Each of the radii R1 through R4 are defined over included angles A1 through A4 as shown in FIG. 14.

Typically, the container of the invention is a relatively low profile container wherein the ratio of the height of the container such as height, H, to the characteristic diameter such as diameter 22 is from about 0.05 to about 0.3. The container may be provided with a plurality of ribs 34, 36, 38 which divide the container into a plurality of serving sections 40 through 44. Perhaps most preferably, there are substantial radii, such as radii 46, between the ribs at the junction with the planar bottom portion which are easier to form than small radii sharp corners. Typically radii at 46 are from about 0.04 to about 0.3 times diameter, D. Radius 47 may be larger than radii 46 as shown. The various ribs typically project upwardly a height 48 which is preferably less than about 0.75 times the height, H, of the container. Perhaps more preferably height 48 is less than about 0.6 times the height of the container; see FIG. 5.

The ribs formed in the container may be of any suitable configuration. A particularly preferred configuration is where section 44 occupies at least about 50% of the surface area of the bottom portion of the container. Even more preferably a single section such as section 44 occupies at least about 60% of the surface area of the bottom portion of the container.

The tabs, besides being operative to guide a paper blank during the forming process in order to maintain it in predetermined orientation with respect to the printing thereon, also can provide a decorative surface for printing. Typically the tabs extend outwardly a distance 32 which is from about 0.02 to about 0.3 times the diameter, D, of the container. The tabs may have an arcuate outer edge as shown in FIGS. 1 and 2 particularly. In such cases the tabs may have a radius of curvature 50 of from about 0.01 to about 0.4 times the diameter, D, or 22 of the plate. Typically radius of curvature 50 is from about 0.05 to about 0.35 times the diameter, D, of the container, and in a typical embodiment the tabs extend a distance of greater than about 0.15 times the diameter, D, of the container, typically from about 0.2 to about 0.25. A particularly preferred embodiment is where the outer flange portion 20 of the container is an arcuate outer flange portion with a convex upper surface 52 as shown particularly in FIG. 13. The radius of curvature of the arcuate outer flange portion 20 is most preferably between about 0.0175 and about 0.1 times characteristic diameter 22 of the container. So also, the flange outer vertical drop 54 is preferably fairly significant. The outer flange vertical drop is generally the distance between the height of the container and the perimeter thereof. As seen in FIG. 14, this distance is the difference between the height of the container, H, and the height of the perimeter Y5. Preferably the ratio of the flange outer vertical drop to the characteristic diameter of the container is greater than about 0.01 and still more preferably greater than about 0.015.

Figure 6:
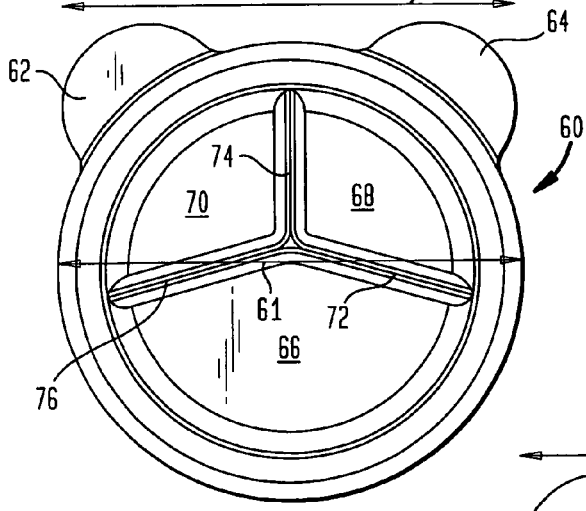
FIG. 6 is a plan view of another plate configured in accordance with the present invention.

As should be appreciated from the foregoing, numerous options within the spirit and scope of the invention are available with respect to the various features of the inventive containers. Some of these options are illustrated schematically in FIGS. 6 through 12 which show different designs of containers constructed in accordance with the present invention. In FIG. 6 there is shown a circular plate 60 having a characteristic diameter 61 as well as two peripheral tabs, 62 and 64. Tabs 62 and 64 define a cross dimension 65 which is parallel to and of like extent with diameter 61 of the plate. Here, the plate is divided into a plurality of sections 66, 68 and 70 by three ribs 72, 74 and 76. Here, the various compartments occupy different areas of the bottom portion of the plate and there are smaller radii between the ribs as opposed to the plate illustrated in FIGS. 1 through 5.

Figure 7:
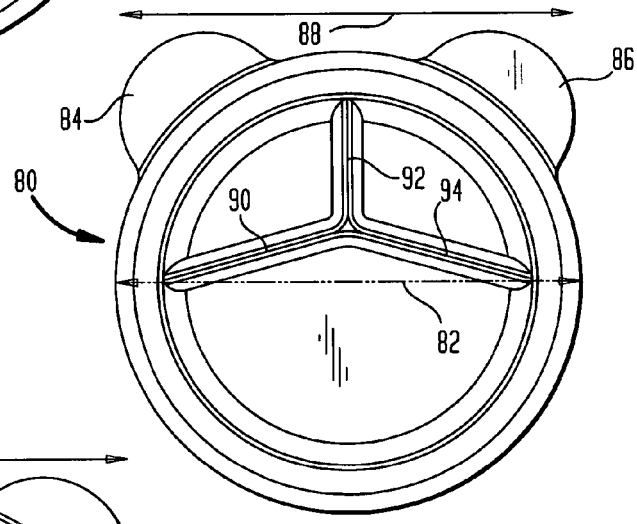
FIG. 7 is a plan view of yet another plate configured in accordance with the present invention.

So also, there is shown in FIG. 7 another plate constructed in accordance with the present invention. There is shown a plate 80 defining a characteristic diameter 82 and a pair of peripheral tabs 84 and 86. The tabs define a cross dimension 88 which is parallel to and of like extent with diameter 82. Here it is noted that the ribs such as ribs 90, 92 and 94 are angularly joined. The ribs are concentrated in one portion of the plate such that a single section in this case section 94 is much larger than the other sections, occupying more than 65% of the bottom of the surface area of the bottom of the container. Here again, there are relatively smaller radii between the ribs as opposed to the plate illustrated in FIG. 1 and following which is also the case in the plate shown in FIG. 8.

Figure 8:
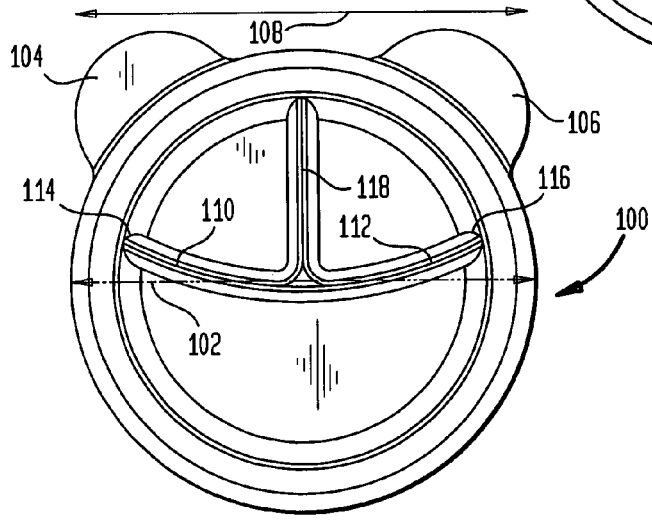
FIG. 8 is a plan view of still yet another plate configured in accordance with the present invention.

There is further shown in FIG. 8 another plate 100 constructed in accordance with the present invention. Plate 100 has a diameter 102 as well as peripheral tabs 104 and 106. Tabs 104 and 106 define a cross dimension 108 generally parallel to and of like extent with diameter 102. Here there is provided two curved lower ribs 110 and 112 which form a continuous arc between points 114 and 116 as well as a rib 118. The particular shape in shown in FIG. 8 is particularly suitable for certain printed designs wherein it is desired to have a continuous arc across the plate.

Figure 9:
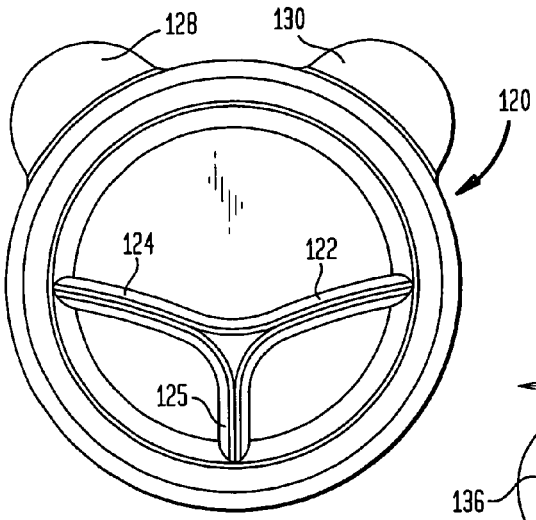
FIG. 9 is a plan view of yet another plate configured in accordance with the present invention.
Figure 10:
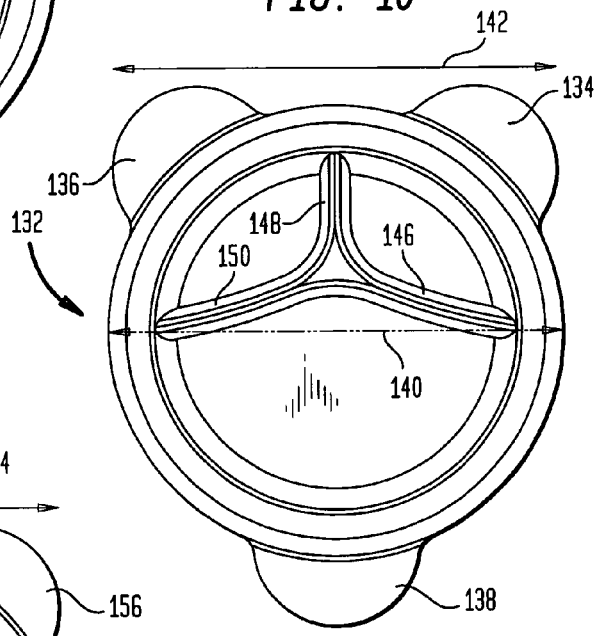
FIG. 10 is a plan view of still yet another plate configured in accordance with the present invention provided with an additional peripheral tab.

So also, the tab design may be altered depending upon the desired aesthetics of the container. There is shown in FIG. 9 for example, a plate 120 wherein ribs 122, 124 and 125 are disposed distally from peripheral tabs 128 and 130. Furthermore, it is also possible to add additional tabs. In FIG. 10, for example, there is provided a container 132 provided with three tabs 134, 136 and 138 spaced around the periphery of the container. Here container 132 has a diameter 140 which is generally parallel to and of like extent with a cross dimension 142 defined by tabs 136 and 134. Ribs 146, 148 and 150 are otherwise as generally described in connection with the ribs of FIG. 1.

Figure 11:
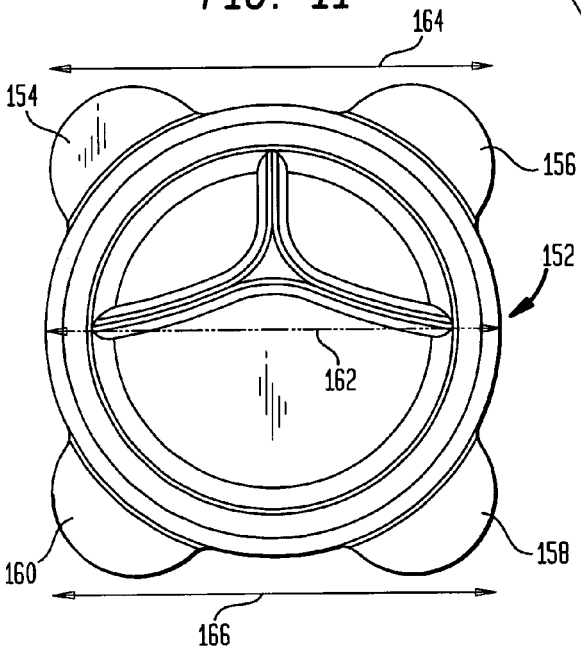
FIG. 11 is a plan view of a plate configured in accordance with the present invention having four peripheral tabs.

In FIG. 11 there is shown a plate 152 provided with four peripheral tabs 154, 156, 158 and 160 disposed around the periphery of the container. The container defines a diameter 162 which is generally parallel to and of like extent with a cross dimension 164 defined by tabs 154 and 156 and is also generally parallel to and of like extent with another cross-direction 166 defined by tabs 158 and 160.

Figure 12:
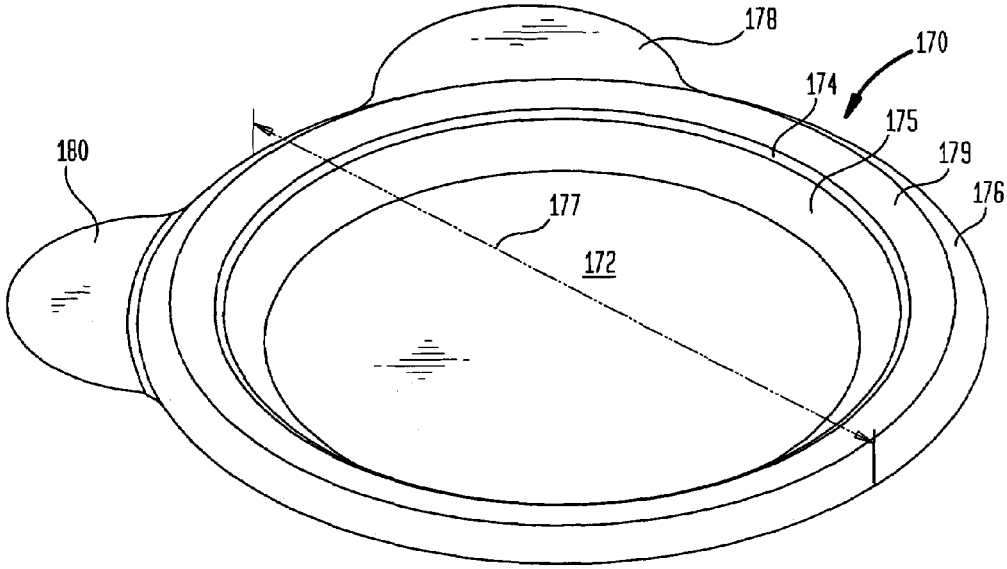
FIG. 12 is a view in perspective of a plate configured in accordance with the present invention without dividing ribs in its substantially planar bottom portion.

Still yet another embodiment of the present invention is shown in FIG. 12 which is a view in perspective of a disposable plate 170 which is provided with a generally planar bottom portion 172 which may be slightly crowned if so desired, a sidewall portion 174 and a flange portion 176, defining diameter 177. There is further provided a first peripheral tab 178 and a second peripheral tab 180 as shown in the diagram. Between bottom portion 112 and sidewall 174 there is a first transition section 175. Likewise between sidewall portion 174 and outer flange portion 176, there is a second annular transition portion 179. Each of the plates shown in the various diagrams, that is, FIG. 1 and FIGS. 6 through 12 may have the profile illustrated in FIGS. 13 and 14 and described above. As noted the profile is generally disclosed in U.S. Pat. No. 5,088,640 to Littlejohn et al. In general, this profile is characterized by smooth and flowing transitions as well as a substantial vertical drop as shown at 54 in FIG. 14 at the outer edge of the container.

The containers of the invention may be made of paper, plastic, and so forth as is known in the art and described in the patents and texts noted herein, the disclosures of which are hereby incorporated by reference. Containers made by way of press-forming a paperboard blank are particularly preferred. The following co-pending patent applications contain further information as to materials, processing techniques and equipment and are also incorporated by reference: U.S. application Ser. No. 10/348,278, entitled "Disposable Food Container With A Linear Sidewall Profile and an Arcuate Outer Flange", now U.S. Pat. No. 6,715,630; U.S. application Ser. No. 09/921,264, entitled "Disposable Serving Plate With Sidewall-Engaged Sealing Cover", now U.S. Pat. No. 6,733,852; U.S. Pat. No. 6,474,497, entitled "Smooth Profiled Food Service Articles"; U.S. application Ser. No. 10/004,874, entitled "High Gloss Disposable Pressware", now U.S. Pat. No. 6,893,693; U.S. application Ser. No. 09/978,484, entitled "Deep Dish Disposable Pressed Paperboard Container", now U.S. Pat. No. 7,048,176; U.S. application Ser. No. 09/653,572, filed Aug. 31, 2000, entitled "Side Mounted Temperature Probe for Pressware Die Sets", now U.S. Pat. No. 6,585,506; U.S. application Ser. No. 09/653,577, filed Aug. 31, 2000, entitled "Rotating Inertial Pin Blank Stops for Pressware Die Sets", now U.S. Pat. No. 6,592,357; U.S. application Ser. No. 09/678,930, filed Oct. 4, 2000, entitled "Punch Stripper Ring Knock-Out for Pressware Die Sets", now U.S. Pat. No. 6,589,043; and U.S. application Ser. No. 10/156,342, entitled "Coated Paperboard, Method and Apparatus for Producing Same", now U.S. Patent No. 2002/0189538. See also, U.S. Pat. No. 5,249,946; U.S. Pat. No. 4,832,676; U.S. Pat. No. 4,721,500; and U.S. Pat. No. 4,609,140, which are particularly pertinent.

The product of the invention is advantageously formed with a heated matched pressware die set utilizing inertial rotating pin blank stops as described in co-pending application U.S. Ser. No. 09/653,577, filed Aug. 31, 2000. For paperboard plate stock of conventional thicknesses in the range of from about 0.010 to about 0.040 inches, the springs upon which the lower die half is mounted are typically constructed such that the full stroke of the upper die results in a force applied between the dies of from about 6000 to 8000 pounds. Similar forming pressures and control thereof may likewise be accomplished using hydraulics as will be appreciated by one of skill in the art. The paperboard which is formed into the blanks is conventionally produced by a wet laid paper making process and is typically available in the form of a continuous web on a roll. The paperboard stock is preferred to have a basis weight in the range of from about 100 pounds to about 400 pounds per 3000 square foot ream and a thickness or caliper in the range of from about 0.010 to about 0.040 inches as noted above. Lower basis weight paperboard is preferred for ease of forming and to save on feedstock costs. Paperboard stock utilized for forming paper plates is typically formed from bleached pulp forming and is usually double clay coated on one side. Such paperboard stock commonly has a moisture (water content) varying from about 4.0 to about 8.0 percent by weight.

The effect of the compressive forces at the rim is greatest when the proper moisture conditions are maintained within the paperboard: at least 8% and less than 12% water by weight, and preferably 9.0 to 10.5%. Paperboard having moisture in this range has sufficient moisture to deform under pressure, but not such excessive moisture that water vapor interferes with the forming operation or that the paperboard is too weak to withstand the high compressive forces applied. To achieve the desired moisture levels within the paperboard stock as it comes off the roll, the paperboard is treated by spraying or rolling on a moistening solution, primarily water, although other components such as lubricants may be added. The moisture content may be monitored with a hand held capacitive type moisture meter to verify that the desired moisture conditions are being maintained or the moisture is monitored by other suitable means, such as an infra-red system. It is preferred that the plate stock not be formed for at least six hours after moistening to allow the moisture within the paperboard to reach equilibrium.

Because of the intended end use of the products, the paperboard stock is typically impregnated with starch and coated on one side with a liquid proof layer or layers comprising a press-applied, water-based coating applied over the inorganic pigment typically applied to the board during manufacturing. In addition, for esthetic reasons, the paperboard stock is often initially printed before being coated with an overcoat layer. As an example of typical coating material, a first layer of latex coating may be applied over the printed paperboard with a second layer of acrylic coating applied over the first layer. These coatings may be applied either using the conventional printing press used to apply the decorative printing or may be applied using some other form of a conventional press coater. Preferred coatings utilized in connection with the invention may include 2 pigment (clay) containing layers, with a binder, of 3 lbs/3000 $ft^2$ ream or so followed by 2 acrylic layers of about 0.5-1 lbs/3000 $ft^2$ ream. The layers are applied by press coating methods, i.e., gravure, coil coating, flexographic methods and so forth as opposed to extrusion or film laminating methods which are expensive and may require off-line processing as well as large amounts of coating material. An extruded film, for example, may require 25 lbs/3000 $ft^2$ ream.

Carboxylated styrene-butadiene resins may be used with or without filler if so desired.

A layer comprising a latex may contain any suitable latex known to the art. By way of example, suitable latexes include styrene-acrylic copolymer, acrylonitrile styrene-acrylic copolymer, polyvinyl alcohol polymer, acrylic acid polymer, ethylene vinyl alcohol copolymer, ethylene-vinyl chloride copolymer, ethylene vinyl acetate copolymer, vinyl acetate acrylic copolymer, styrene-butadiene copolymer and acetate ethylene copolymer. Preferably, the layer comprising a latex contains styrene-acrylic copolymer, styrene-butadiene copolymer, or vinyl acetate-acrylic copolymer. More preferably, the layer comprising a latex contains vinyl acetate ethylene copolymer. A commercially available vinyl acetate ethylene copolymer is "AIRFLEX® 100 HS" latex. ("AIRFLEX® 100 HS" is a registered trademark of Air Products and Chemicals, Inc.) Preferably, the layer comprising a latex contains a latex that is pigmented. Pigmenting the latex increases the coat weight of the layer comprising a latex thus reducing runnability problems when using blade cutters to coat the substrate. Pigmenting the latex also improves the resulting quality of print that may be applied to the coated paperboard. Suitable pigments or fillers include kaolin clay, delaminated clays, structured clays, calcined clays, alumina, silica, aluminosilicates, talc, calcium sulfate, ground calcium carbonates, and precipitated calcium carbonates. Other suitable pigments are disclosed, for example, in *Kirk-Othmer, Encyclopedia of Chemical Technology*, Third Edition, Vol. 17, pp. 798, 799, 815, 831-836. Preferably the pigment is selected from the group consisting of kaolin clay and conventional delaminated coating clay. An available delaminated coating clay is "HYDRAPRINT" slurry, supplied as a dispersion with a slurry solids content of about 68%. "HYDRAPRINT" slurry is a trademark of Huber. The layer comprising a latex may also contain other additives that are well known in the art to enhance the properties of coated paperboard. By way of example, suitable additives include dispersants, lubricants, defoamers, film-formers, antifoamers and crosslinkers. By way of example, "DISPEX N-40" is one suitable organic dispersant and comprises a 40% solids dispersion of sodium polycarboxylate. "DISPEX N-40" is a trademark of Allied Colloids. By way of example, "BERCHEM 4095" is one suitable lubricant and comprises 100% active coating lubricant based on modified glycerides. "BERCHEM 4095" is a trademark of Bercap. By way of example, "Foamaster DF-177NS" is one suitable defoamer. "Foamaster DF-122 NS" is a trademark of Henkel. In a preferred embodiment, the coating comprises multiple layers that each comprise a latex.

The stock is moistened on the uncoated side after all of the printing and coating steps have been completed. In a typical forming operation the web of paperboard stock is fed continuously from a roll through a scoring and cutting die to form the blanks which are scored and cut before being fed into position between the upper and lower die halves. The die halves are heated as described above, to aid in the forming process. It has been found that best results are obtained if the upper die half and lower die half—particularly the surfaces thereof—are maintained at a temperature in the range of from about 250° F. to about 400° F., and most preferably at about 325° F.±25° F. These die temperatures have been found to facilitate the plastic deformation of paperboard in the rim areas if the paperboard bas the preferred moisture levels. At these preferred die temperatures, the amount of heat applied to the blank is sufficient to liberate the moisture within the blank and thereby facilitate the deformation of the fibers without overheating the blank and causing blisters from liberation of steam or scorching the blank material. It is apparent that the amount of heat applied to the paperboard will vary with the amount of time that the dies dwell in a position pressing the paperboard together. The preferred die temperatures are based on the usual dwell times encountered for normal plate production speeds of 40 to 60 pressings a minute, and commensurately higher or lower temperatures in the dies would generally be required for higher or lower production speeds, respectively.

A die set wherein the upper assembly includes a segmented punch member and is also provided with a contoured upper pressure ring is advantageously employed in carrying out the present invention. Pleating control is preferably achieved in some embodiments by lightly clamping the paperboard blank about a substantial portion of its outer portion as the blank is pulled into the die set and the pleats are formed. For some shapes the sequence may differ somewhat as will be appreciated by one of skill in the art. Paperboard containers configured in accordance with the present invention are perhaps most preferably formed from scored paperboard blanks.

Figure 15:
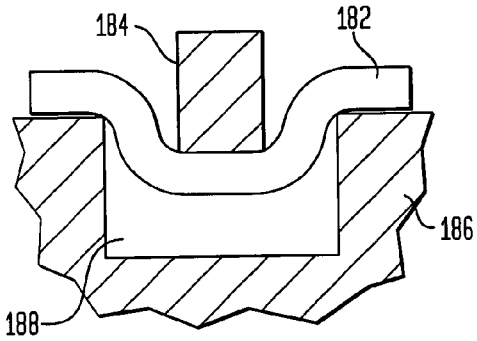
FIGS. 15 through 18 are schematic diagrams illustrating a scoring operation.
Figure 16:
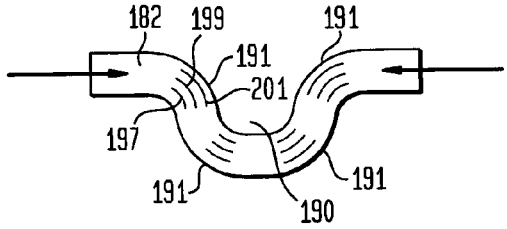
Figure 17:
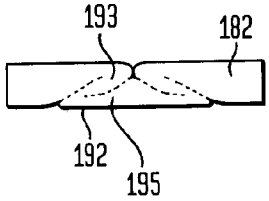
Figure 18:
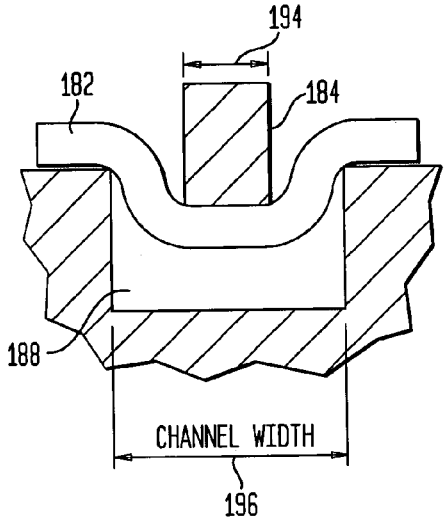

In FIG. 15 there is shown a portion of paperboard stock 182 positioned between a score rule 184 and a scoring counter 186 provided with a channel 188 as would be the case in a scoring press or scoring portion of a pressware forming press. The geometry is such that when the press proceeds reciprocally downwardly and scores blank 182, U-shaped score 190 results. At least incipient delamination of the paperboard into lamellae indicated at 197, 199, 201 is believed to occur in the sharp corner regions indicated at 191 in FIG. 16. The same reciprocal scoring operation could be performed in a separate press operation to create blanks that are fed and formed subsequently. Alternatively, a rotary scoring and blanking operation may be utilized as is known in the art. When the product is formed in a heated matched die set, a U-shaped pleat 192 with a plurality of lamellae of rebonded paperboard-along the pleat in the product is formed such that pleats 192 (or 19 as shown in FIG. 1) generally have such configuration. The structure of pleat 192 is preferably as shown schematically in FIG. 17. During the forming process described hereinafter, internal delamination of the paperboard into a plurality of lamellae as a pleat is formed occurs, followed by rebonding of the lamellae under heat and pressure into a substantially integrated fibrous structure generally inseparable into its constituent lamellae. Preferably, the pleat has a thickness generally equal to the circumferentially adjacent areas of the rim and most preferably is more dense than adjacent areas. Integrated structures of rebonded lamellae are indicated schematically at 193, 195 in FIG. 17 on either side of paperboard fold lines in the pleat indicated in dashed lines.

The substantially rebonded portion or portions of the pleats 192 in the finished product preferably extend generally over the entire length (75% or more) of the score which was present in the blank from which the product was made.

Figure 13:
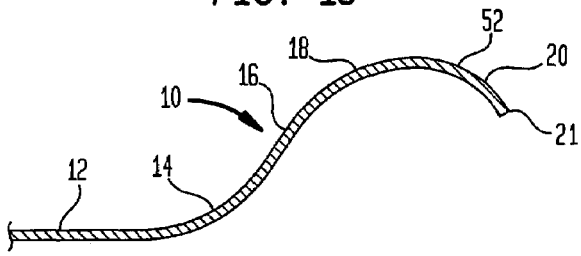
FIG. 13 is a diagram illustrating the profile of the paper plate of FIG. 1 along a portion without a rib or tab.

The rebonded portion of the pleats may extend only over portions of the pleats in an annular region of the periphery of the article in order to impart strength. Such an annular region or regions may extend, for example, around the container extending approximately from the transition of the bottom of the container to the sidewall outwardly to the outer edge of the container, that is, generally along the entire length of the pleats shown in FIGS. 1 and 2. The rebonded structures may extend over an annular region which is less than the entire profile from the bottom of the container to its outer edge. Referring to FIG. 13, for example, an annular region of rebonded structures oriented in a radial direction may extend around the container from inner transition 14 to outermost edge 21. Alternatively, an annular region or regions of such rebonded structures may extend over all or only a portion of the length of sidewall 16; over all or part of second annular transition portion 18; over all or part of outer arcuate flange portion 20; or combinations thereof. It is preferable that the substantially integrated rebonded fibrous structures formed extend over at least a portion of the length of the pleat, more preferably over at least 50% of the length of the pleat and most preferably over at least 75% of the length of the pleat. Substantially equivalent rebonding can also occur when pleats are formed from unscored paperboard.

At least one of the optional sidewall portion, the second annular transition portion, and the outer flange portion is provided with a plurality of circumferentially spaced, radially extending regions formed from a plurality of paperboard lamellae rebonded into substantially integrated fibrous structures generally inseparable into their constituent lamellae. The rebonded structures extend around an annular region corresponding to a part of the profile of the optional sidewall, second annular transition portion or the outer flange portion of the container. More preferably, the integrated structures extend over at least part of all of the aforesaid profile regions about the periphery of the container. Still more preferably, the integrated rebonded structures extend generally over the length of the pleats, over at least 75% of their length, for instance; however, so long as a majority of the pleats, more than about 50% for example, include the rebonded structures described herein over at least a portion of their length, a substantial benefit is realized. In some preferred embodiments, the rebonded structures define an annular rebonded array of integrated rebonded structures along the same part of the profile of the container around an annular region of the container. For example, the rebonded structures could extend along the optional sidewall portion of all of pleats 19 shown in FIGS. 1 and 2 along a length to define an annular array around the optional sidewall portion of the container.

Figure 19:
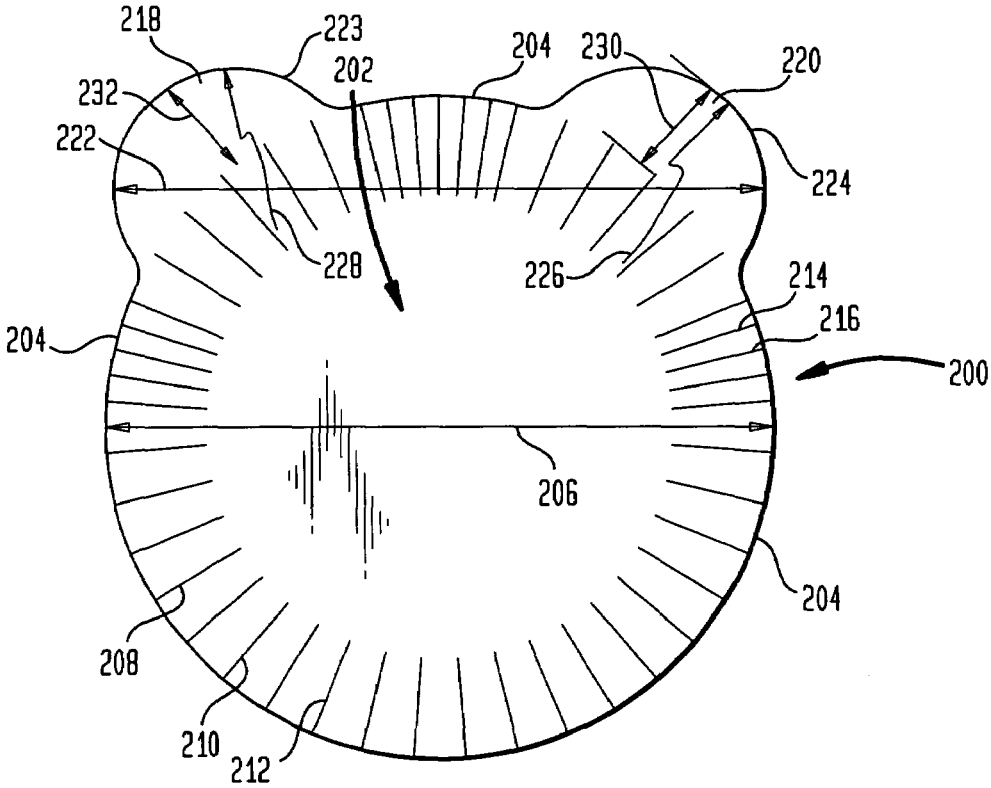
FIG. 19 is a schematic diagram of a paperboard blank which is scored with 49 scores of non-uniform spacing.
Figure 20:
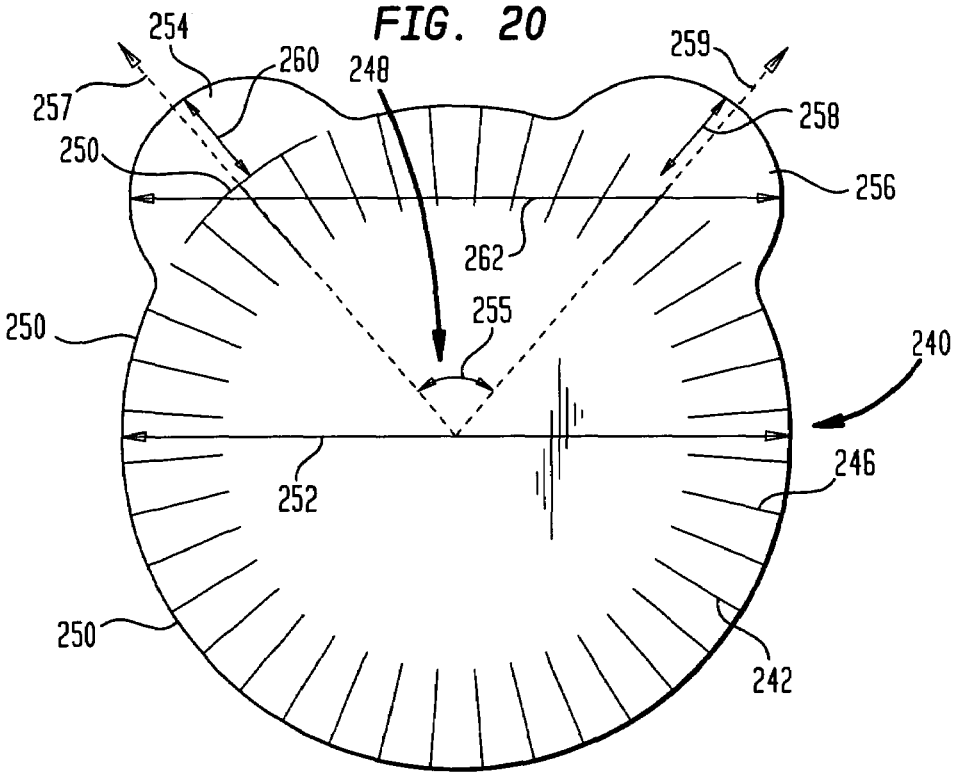
FIG. 20 is a plan view of a scored paperboard blank of the present invention provided with 40 evenly spaced scores.

Paperboard blanks of the present invention are shown in plan view in FIGS. 19 and 20. In FIG. 19 a paperboard blank 200 is generally planar and includes a central portion 202 defining generally thereabout a perimeter 204 having a characteristic diameter 206. There is provided about the perimeter 204 of blank 200 a plurality of scores such as scores 208, 210 and 212. While scores 208 through 212 are evenly spaced, there may be additional scores such as scores 214 and 216 which are more closely spaced. In other words, it is not necessary that the scores be evenly spaced about the periphery of the perimeter of the paperboard blank. However, it has been found in accordance with the present invention that it is preferred that the tab portions of the blank such as tabs 218 and 220 remain unscored. Likewise tabs 218 and 220 define a cross tab dimension 222 which is generally parallel to and of like extent with diameter 206 of the central portion of the paperboard blank.

Tabs 218 and 220 generally have arcuate outer edges 223 and 224 having radii of curvature 226 and 228 of from about 0.01 to about 0.3 times diameter 206.

Typically, the peripheral tabs such as tabs 218 and 220 extend beyond the perimeter a distance such as distances 230 and 232 which is from about 0.02 to about 0.3 times diameter 206 of the paperboard blank.

Figure 21:
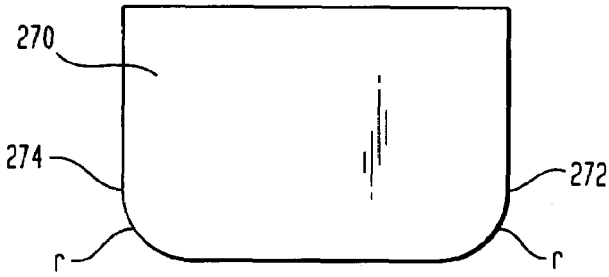
FIG. 21 is a schematic diagram of a scoring rule provided with radii about each terminal portion thereof.

In FIG. 20 there is shown a paperboard blank 240 having a plurality of evenly spaced scores such as scores 242 and 246. In FIG. 20 there are provided 40 scores; that is a score for every nine degrees of curvature. For bowls, it is desirable to increase the number of scores, for example one might double the number of scores when using a blank for a bowl as opposed to a plate which would have a larger product diameter. Paperboard blank 240 likewise comprises a central portion 248 having a perimeter 250 and defining a diameter 252. There is further provided tabs 254 and 256 which extend peripheral distances 258 and 260 beyond perimeter 250. So also, the paperboard blank of FIG. 20 defines a cross-tab dimension 262 generally parallel to and of like extent with diameter 252 of paperboard blank 240. Here again, it is noted that tabs 254 and 256 are unscored. While any suitable rule may be used to score the paperboard blanks, such as paperboard blanks 200 and 240 it has been found that it is preferable to use a rule which is provided with a radius on both its inner and outer edges for the scores that terminate in the tab areas so as to discourage propagation of pleats into the peripheral tab areas. Scores in other areas typically made with a score rule that has a radius on its inner portion only since the scores may extend beyond the blank diameter. There is shown schematically in FIG. 21 a scoring rule 270 provided with an outer edge 272 provided with a radius, r, and an inner edge 274 also provided with a radius of curvature, r, which may be about 0.06 inches or so. Otherwise the rule is generally a conventional 0.028 inch thickness scoring rule. Using a rule with both an inner and outer radius of curvature is necessary only in the tab areas of the blank; that is, adjacent tabs 254 and 256 of paperboard blank 240, for example.

It should be noted that the tabs on a blank or on a container are angularly offset from one another by an included angle which is generally less than 150°. The included angle 255 is the angle between centerlines 257, 259 of tabs 254, 256 at their intersection at the center point of the central portion of the blank as shown in FIG. 20. For a shape where the blank or formed product is not circular, the geometric center is used. Typically, the included angle between tabs is less than 120° and in many embodiments is from about 70° to about 90° and is selected in connection with the length of the tab.

Figure 22:
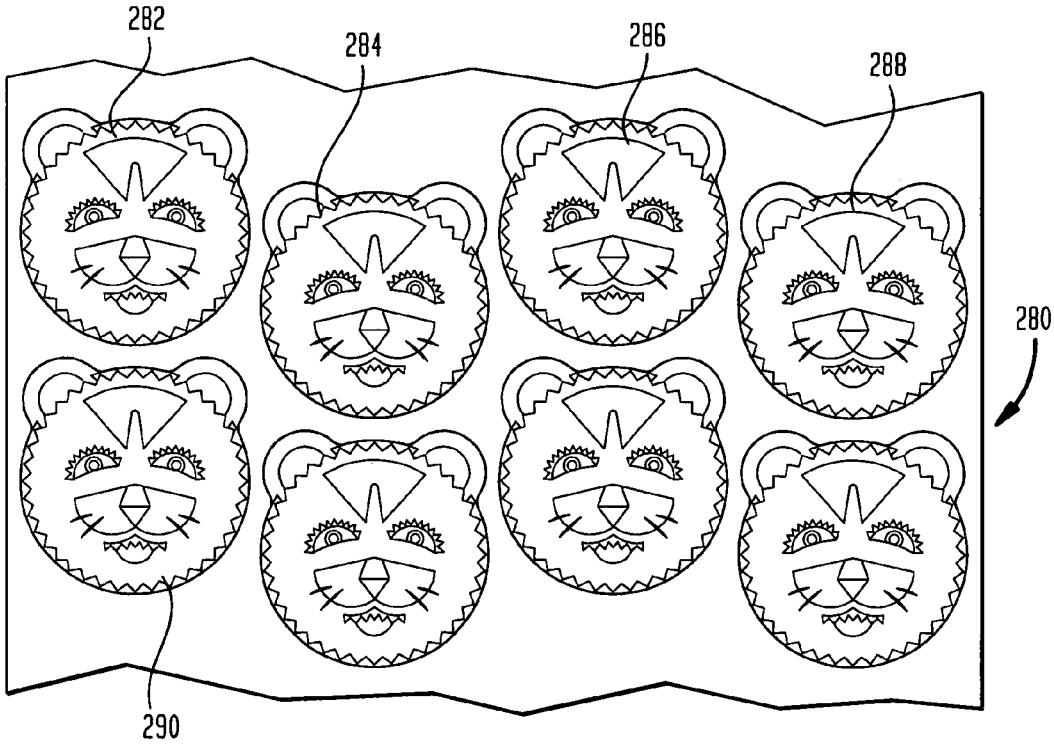
FIG. 22 is a schematic diagram of a layout of printed paperboard blanks on a web.

While any suitable method may be used to prepare paperboard blanks in accordance with the present invention, it is noted that a web-fed process is perhaps most preferred. There is shown in FIG. 22 a blank web layout for paperboard blanks having the general shape shown in FIGS. 19 and 20 and optionally provided with printing. It can be seen from FIG. 22, that the layout 280 of paperboard blanks 282, 284, 286, 288, 290 and so on is generally nested to minimize scrap. Some cross-direction spacing between printed images is desirable so that the paperboard blanks can be transferred from the blanking and scoring stations to their respective forming die sets while controlling their orientation and disposition by way of dedicated transfer chutes. It will further be appreciated from the discussion which follows that the printing of images including character attributes such as facial features and ears as shown in FIG. 22, can be positioned in a predetermined position with respect to ribs in the plate, for example. It is highly desirable to keep the character attributes in a pre-determined orientation and position with respect to ribs formed in the paperboard blank when making a product. The character attributes may include eyes, noses and the like and the tabs may be printed with additional character attributes such as ears, feet, fins, arms, legs, hands and the like.

The inventive paperboard blanks are particularly suited for forming containers wherein it is important to control the orientation of the paperboard blank from the printing step to forming in a pressware die set.

Figure 23:
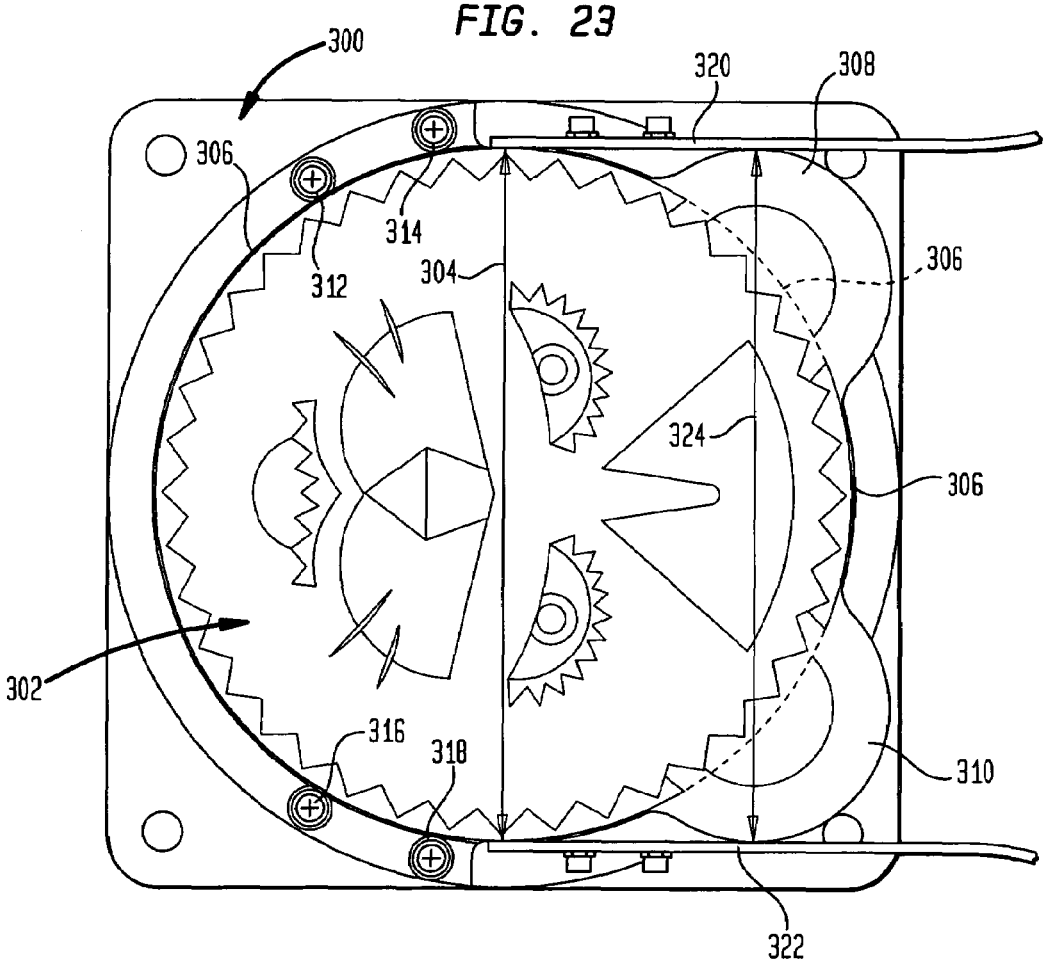
FIG. 23 is a schematic diagram illustrating a paperboard blank oriented in the bottom portion of a pressware die set.

In FIG. 23 there is shown the lower portion or die 300 of a pressware die set wherein a paperboard blank 302 has been provided thereto. Paperboard blank 302 has a diameter 304 around its perimeter 306 as well as tabs 308 and 310 projecting outwardly from perimeter 306. Blank 302 is positioned on the lower portion of die set 306 by blank stops such as blank stops 312, 314, 316 and 318. It is guided to the position shown in FIG. 23 by way of tracks 320 and 322. Tracks 320 and 322 are in opposed relationship and are generally parallel in order to control the orientation of the blank as shown in the diagram. It is noted that paperboard blank 302 defines a cross-tab dimension 324 which is generally parallel and of like extent with diameter 304 of blank 302 such that the paperboard blank is prevented from rotating upon transfer to die 300. That is to say, tabs 308 and 310 cooperate with tracks 320 and 322 by virtue of the fact they define a cross-tab dimension 324 to control the orientation of blank 302 in the die set. Some clearance is desirable between the blank and guide tracks, preferably less than about 30 mils. So also, the guides should be flared somewhat as required. In this way the printed matter as shown on paperboard blanks 282 to 290 may be kept in a pre-determined registry with ribs such as the ribs shown on FIG. 30 and in pre-determined registry with grooves such as the grooves shown on FIG. 31 discussed later herein. The guides and stops are selected so as to be suitable for the blank employed.

Once positioned as desired in the die set, the paperboard blank, such as paperboard blank 302 is formed into a container as shown schematically in FIGS. 24 through 29. FIGS. 24 through 29 are partial schematic views in section along the centerline of a groove and male rib portion of the die set wherein the punch knock-out is articulated and includes grooves while the die knock-out includes a plurality of cantilevered rib portions as shown in perspective in FIGS. 30 and 31. The die geometry and sequencing of operation will vary with the particular product.

Figure 24:
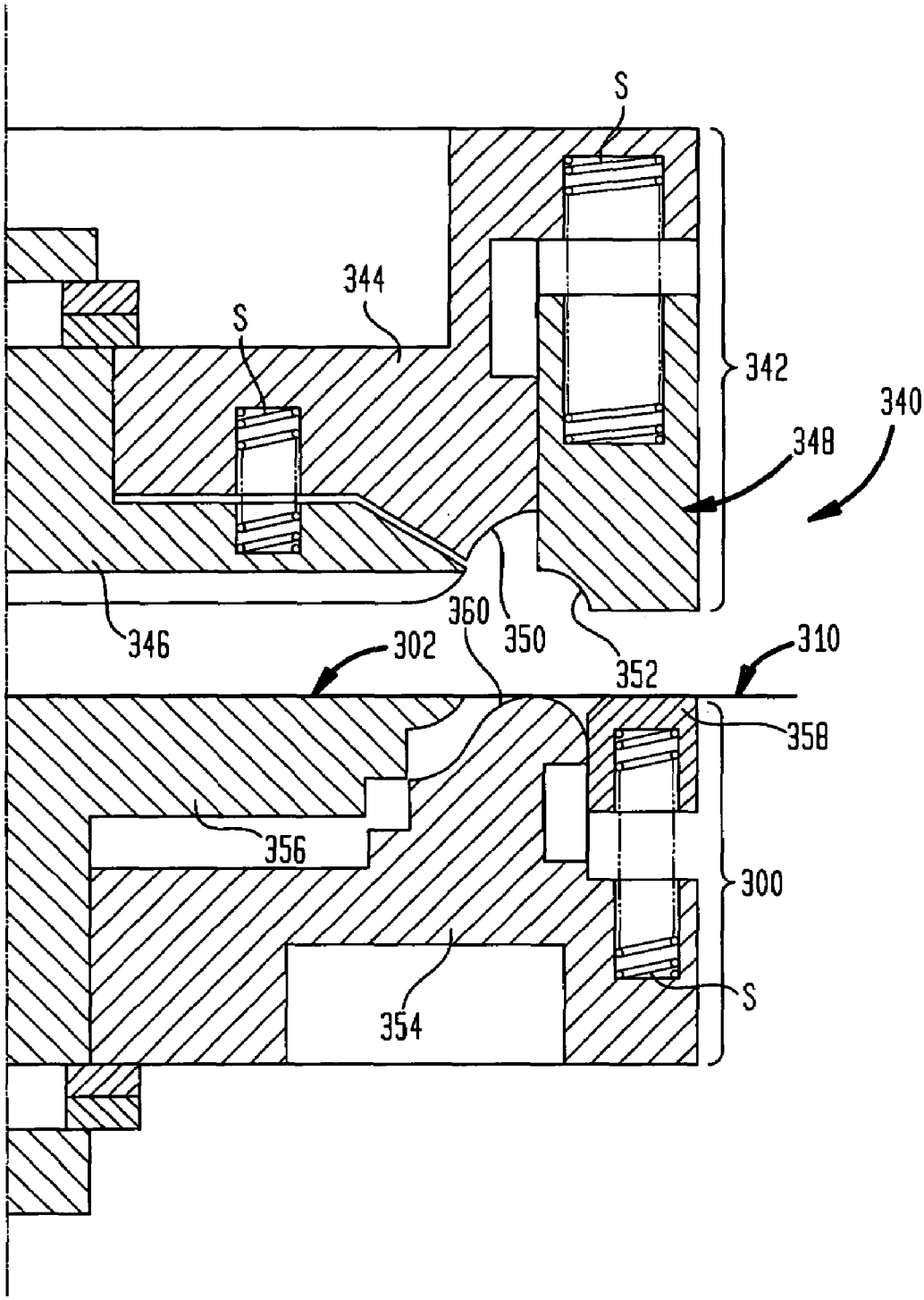
FIGS. 24 through 29 are schematic diagrams illustrating the operation of a pressware die set to make disposable plates configured in accordance with the present invention.

FIGS. 24 through 29 show a pressware die set 340 which includes a lower die 300 and an upper punch 342. Punch portion 342 of die set 340 includes a punch base 344 as well as a punch knock-out 346 and a pressure ring 348. Punch base 344 includes a product outer contour portion indicated at 352. Initially, blank 302 is positioned on die 300 of die set 340 as shown in FIGS. 23 and 24 when the die set is open. Die 300 includes a die base 354, a knock-out 356, as well as an associated draw ring 358. Die base 354 includes an outer contour portion 360 used for forming the sidewall of the container in cooperation with the outer contour portion 350 of the punch base.

The die set shown schematically in FIGS. 24 through 29 are what is known in the art as a segmented die set since the various parts are mounted for reciprocating motion with respect to each other as well as with respect to the opposed surfaces of corresponding parts. That is to say draw ring 358 for example is mounted for reciprocating motion with respect to die base 354 as is punch knock-out 346. Typically, the various parts are spring-biased; springs are typically located generally where indicated by the letter "S" on the various diagrams.

Likewise, knock-out 356 is mounted for reciprocating motion with respect to die base 354. So also, draw ring 358 is spring-mounted for movement with respect to die base 354 as will be appreciated from the discussion which follows. The draw ring and pressure ring are spring loaded in the case illustrated such that the draw ring is fully retracted before the pressure ring begins to retract with respect to the punch base as is discussed in some detail following.

Figure 25:
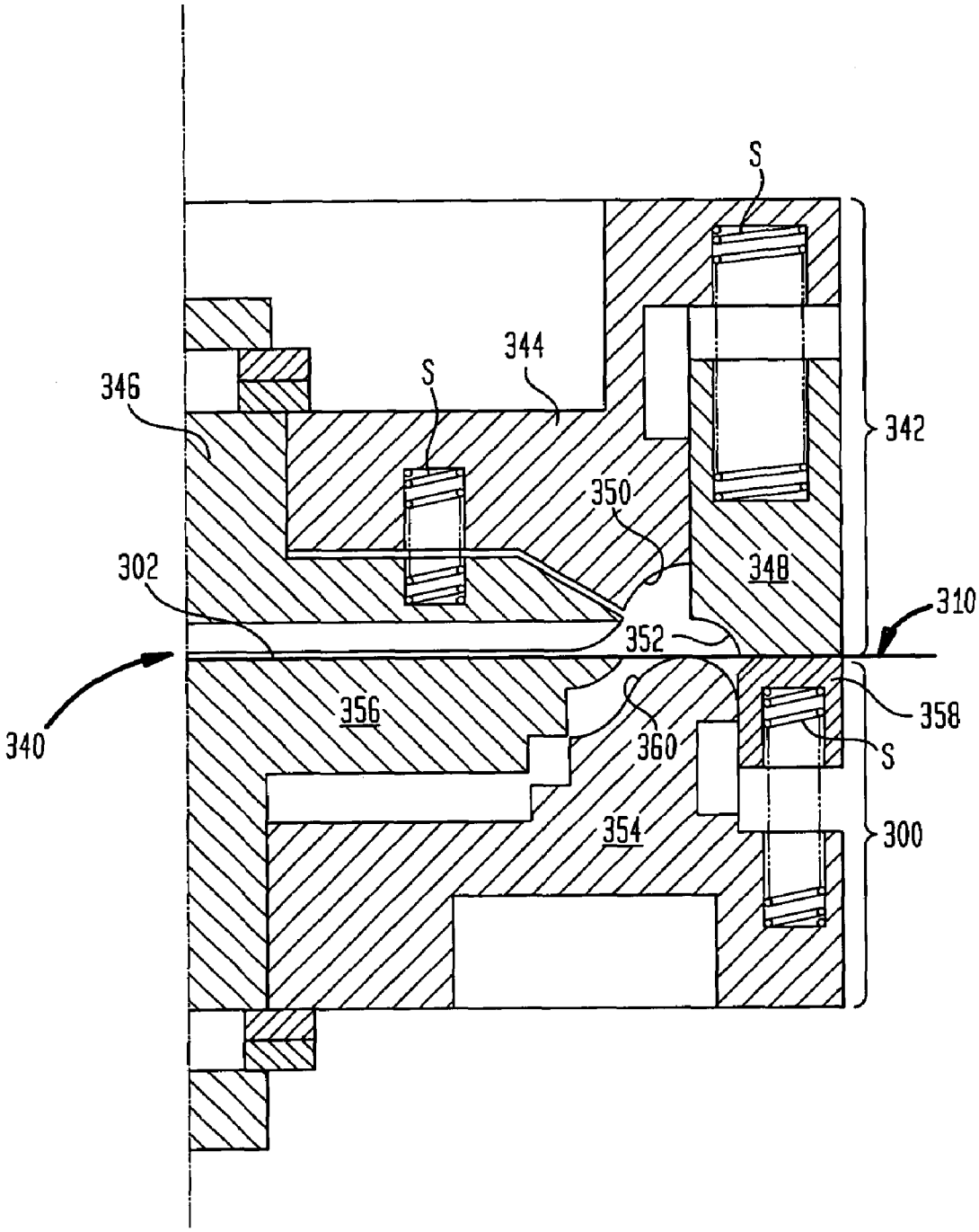
Figure 26:
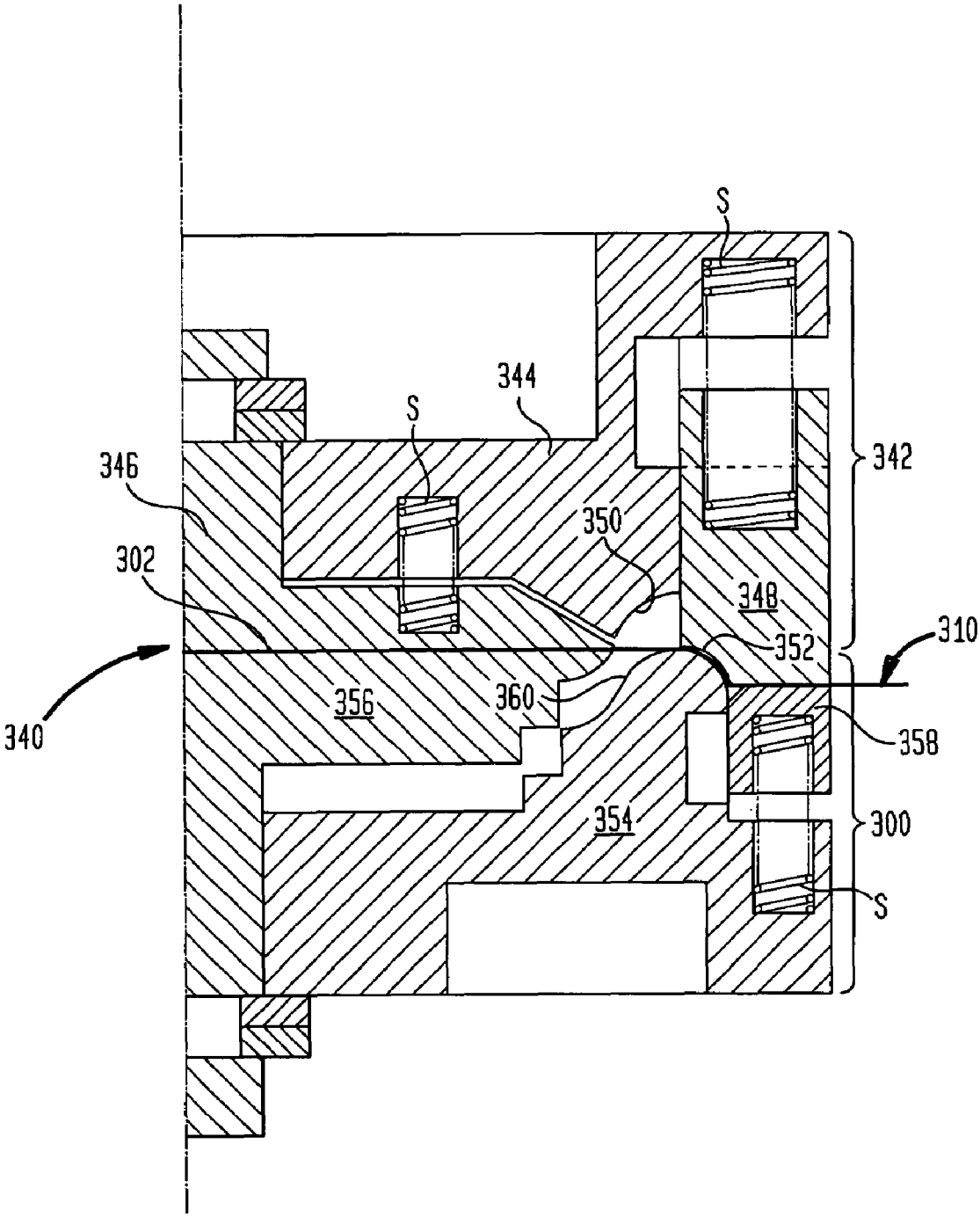
Figure 27:
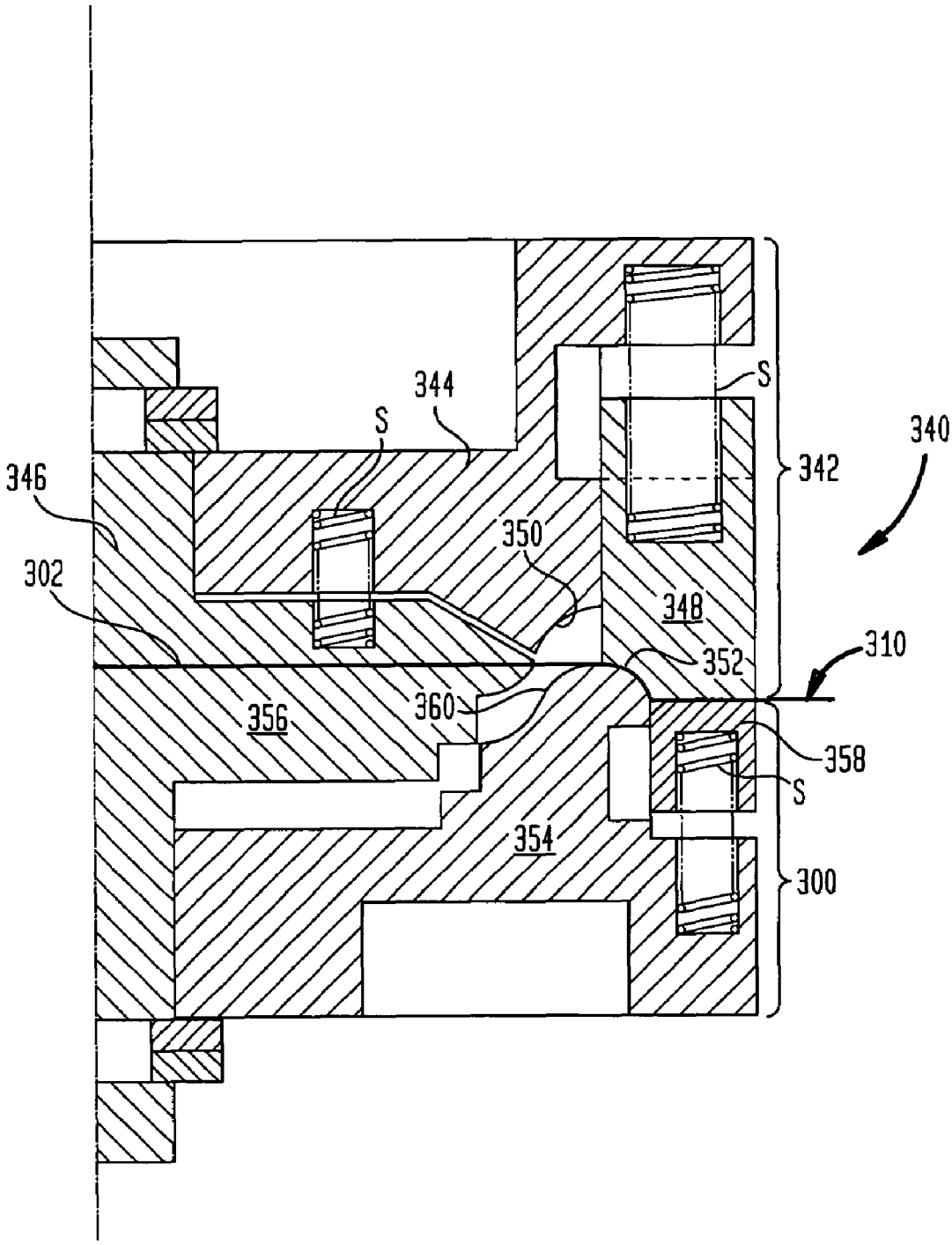
Figure 28:
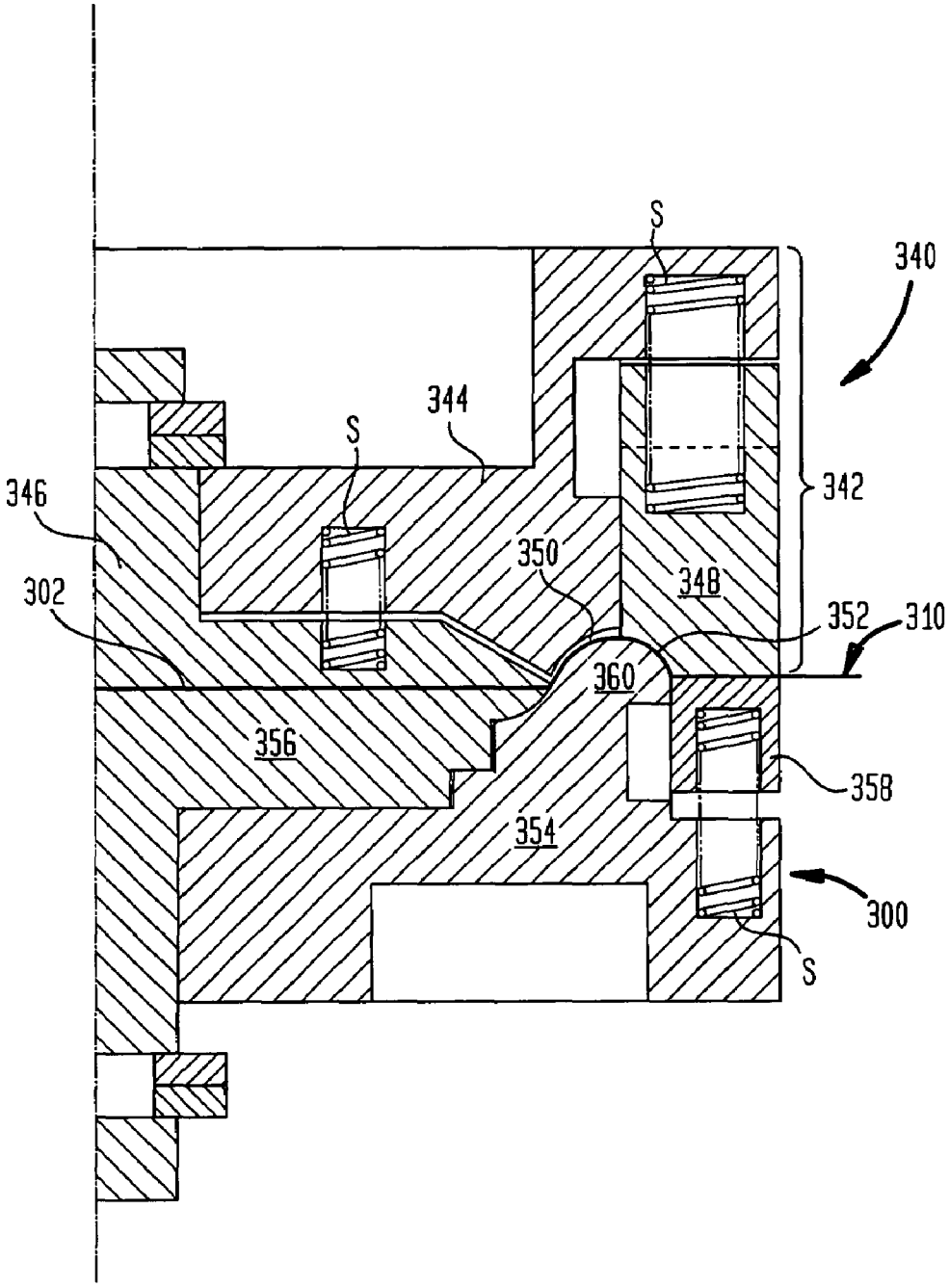

FIGS. 24 through 29 illustrate the sequential formation of a container of the present invention from a container blank such as blank 302. In FIG. 24 it is seen that blank 302 is positioned in die set 340 in a fully open position, such that tab 310 protrudes beyond the die set. In FIG. 25 the punch is shown to have been advanced toward die 300 such that pressure ring 348 and draw ring 358 clamp on to blank 302 holding it in position while the knock-outs 346 and 356 are moved into proximity with the paperboard blank 302. It is noted at the early stages that the contour portions such as portions 350, 352 and 360 have not yet begun to form the outer periphery of the inventive container. In FIG. 26 the die set continues to close, with its punch portion 342 continuing to advance towards the die portion 300 wherein punch knock-out 346 and die knock-out 356 begin to preform any features in the central portion of the container, such as ribs shown in FIG. 1 and following. Here, it is seen that pressure ring 348 continues to advance and the outer portion of the flange of the container begins to form as well. In FIG. 27, at a more advanced stage of formation, pressure ring 348 and die contour 360 are applying force to paperboard blank 302. Likewise, the knock-outs 346 and 356 continue to pre-form the central portion of the container. In FIG. 28, punch 342 and die 300 are almost fully advanced. Knock-out 346 and knock-out 356 are pre-forming the plate bottom and compartment ribs. Other contour portion 350 of punch base 344 has not yet fully contacted the outer portion of the blank.

Figure 29:
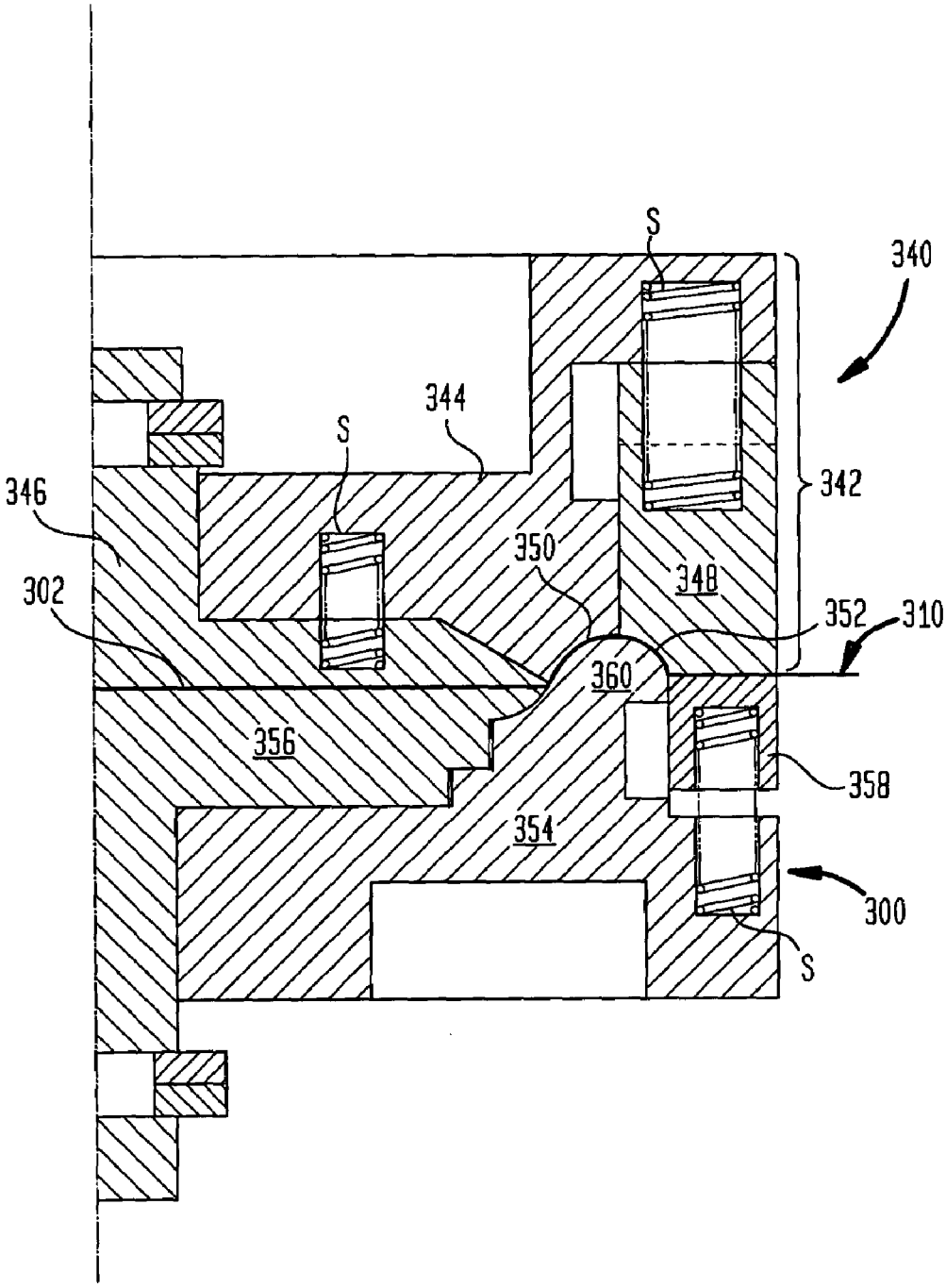
Figure 30:
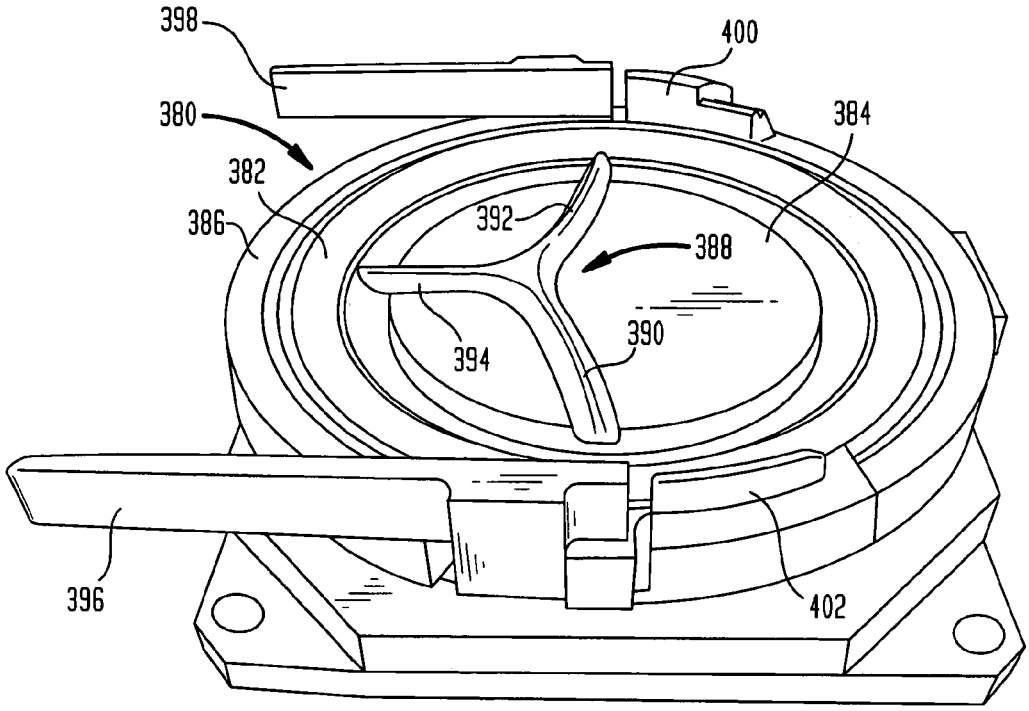
FIG. 30 is a schematic view in perspective of a segmented die set provided with a plurality of rib portions for forming divider ribs in the bottom portion of the containers of the present invention and wherein the die set is provided with guide tracks.
Figure 31:
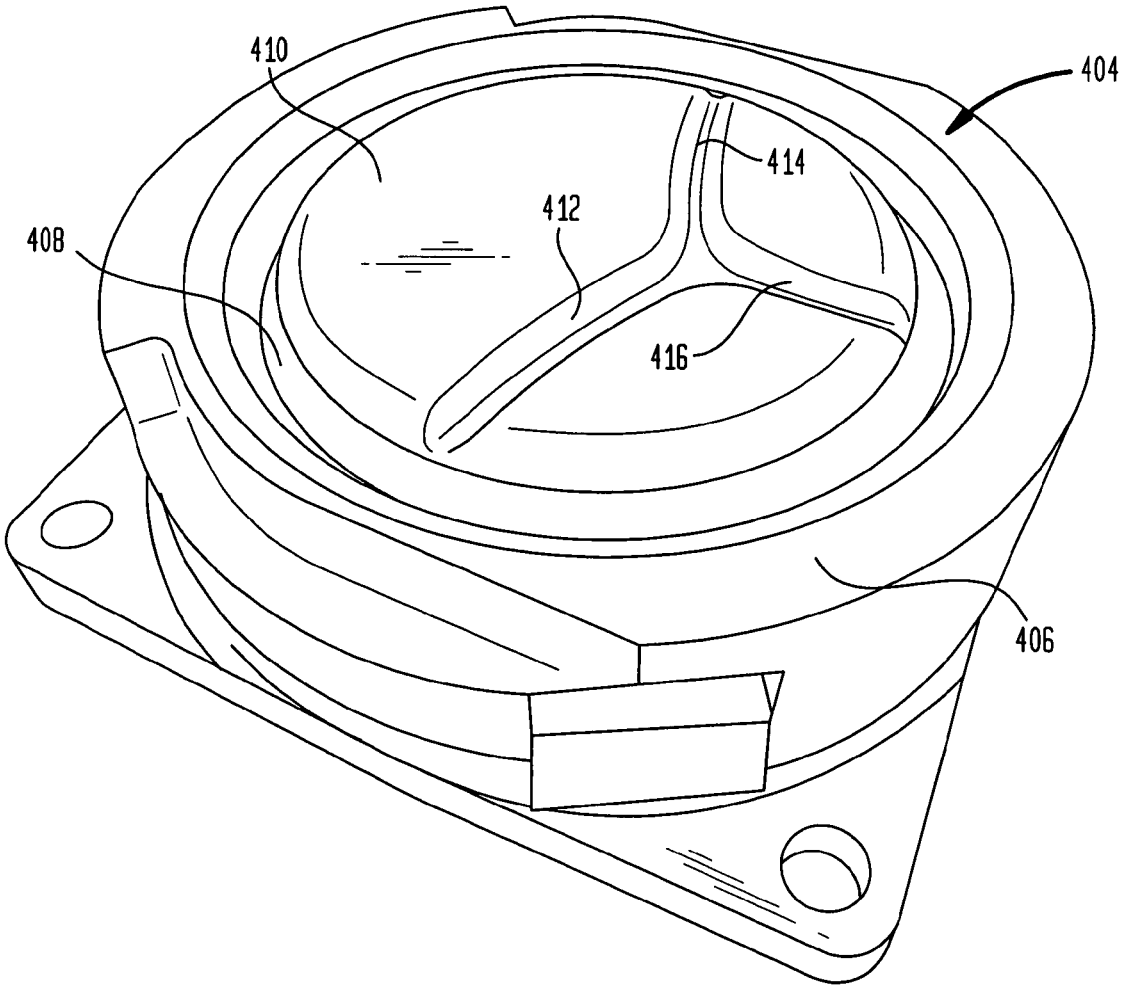
FIG. 31 is a view in perspective of the punch of a segmented die set provided with an articulated and grooved punch knock-out adapted to produce compartmented containers of the present invention.

In FIG. 29 it is seen that the die set is fully closed and all features of the product are formed. Here, features such as ribs and the like are fully developed as are the pleats in the product. Following formation, the process is reversed and product is ejected from the die set, optionally with pressurized air-assist. A particularly preferred die of a die set is shown in FIG. 30. There is shown in FIG. 30 a segmented die portion 380 of a segmented die set including a die base 382, a die knock-out 384 as well as a draw ring 386. Knock-out 384 is provided with a plurality cantilevered ribs indicated at 388 including three cantilevered ribs 390, 392, and 394 as shown. There is further provided a pair of opposed guide tracks 396 and 398 which position a blank on die portion 380 prior to forming. Blank stops 400 and 402 are also shown. The blank stops shown are of the fixed guide type, however, one could also utilize rotating pin blank stops as appear in FIG. 23 and which are disclosed, for example, in U.S. patent application Ser. No. 09/653,577 referred to above. In FIG. 31, a matching punch assembly 404 is mounted to opposed die 380 when forming a compartmented plate. Punch 404 includes a pressure ring 406 as well as a punch base 408 and a punch knock-out 410. Punch knock-out 410 includes a plurality of grooves 412, 414 and 416 configured to cooperate with die ribs shown at 388 to form the ribs in the container.

As will be appreciated from the foregoing and from FIG. 23 a printed paperboard blank provided with a printed image of predetermined position with respect to the peripheral tabs is provided to the die set. The guides, such as guides 396 and 398 position the printed paperboard blank with respect to the ribs 390, 392 and 394 at 388 and grooves 412, 414 and 416 such that there is a predetermined correspondence of the printed image with the ribs formed in a container. This correspondence is maintained throughout the manufacturing process by controlling the orientation of the paperboard blank by virtue of the tabs cooperating with tracks which may extend to the die set such as tracks 396 and 398. This control would not be possible of course with a round paperboard blank which would tend to rotate as it is transferred to the forming die set. Thus, there is provided in accordance with the present invention a method for forming the container with a plurality of ribs in predetermined correspondence with a printed image on the paperboard blank. Post-forming trimming is not required since the outer perimeter is relatively uniform even with ribs due to the arcuate outer profile of the container. The diameter of the outer perimeter may vary somewhat where ribs intersect the sidewall of the container since less paperboard is drawn into the tool in these areas.

Draw and/or pressure rings may include one or more of the features: circular or other shape designed to match product shape; external location with respect to the forming die or punch base and die or base contour; stops (rigid or rotating) connected thereto to locate blank prior to formation; cut-out "relief" area that is approximately the same depth as the paperboard caliper and slightly larger than the blank diameter to provide a reduced clamp force before pleating starts to occur and may extend with clearance into the tab areas to reduce clamp force during draw-in of the tabs; this provides initial pleating control before arcuate outer area contacts and provides final pleating control; relief areas may be desirable in the tab areas of the blank to reduce tension and stretch that may damage coating during formation; radiused outer edges where the blank tabs are contacted to further reduce tension and stretch that may damage the coating during formation; 3 to 4 L-shaped brackets each (stops) are bolted into both the draw and pressure rings around their perimeters and contact milled-out areas in the respective die and punch forming bases or contours to provide the springs with preload distances and forces; typical metal for the draw ring is steel, preferably AISI 1018, typical surface finishes of 125 rms are standard for the draw ring, 63 rms are desired for the horizontal top surface, and inner diameter, a 32 rms finish is desired on the horizontal relief surface; pins and bushings are optionally added to the draw and pressure rings and die and punch bases to minimize rotation of the rings; inner diameter of the pressure ring may be located relatively inwardly at a position generally corresponding to the outer part of the second annular transition of the container or relatively outwardly at a position generally corresponding to the inner part of the arcuate outer flange or at a suitable location therebetween; the draw and pressure ring inner diameters should be slightly larger than the matching bases/contours such as to provide for free movement, but not to allow significant misalignments due to loose tolerencing; 0.005" to 0.010" clearance per side (0.010" to 0.020" across the diameter) is typical; 4 to 8 compression springs each per draw ring and pressure ring typically are used to provide a preload and full load force under pre and full deflections; machined clearance holes for the springs should be chamfered to ensure no binding of the springs during the deflection; the spring diameters, free lengths, manufacturer and spring style can be chosen as desired to obtain the desired draw ring and pressure ring preloads, full load and resulting movements and clamping action; to obtain the desired clamping action the preload of the pressure ring springs (total force) should be slightly greater that the fully compressed load of the draw ring springs (total force); the preload of the draw ring springs should be chosen to provide adequate pleating control while not clamping excessively hard on the blank while in the draw ring relief; for example, (6) draw ring compression springs LC-059G-11 SS (0.48" outside diameter, 0.059" wire diameter, 2.25" free length, spring rate 18 lb/in×0.833 (for stainless steel)=14.99 lb/in, and a solid height of 0.915"); a 0.375" preload on each spring provides a total preload force of (6)×14.99 lb/in×0.375"=33.7 lbs; an additional deflection of the springs of 0.346" or (0.721" total spring deflection) results in a total full load force of (6)×14.99 lb/in×0.721"=64.8 lbs; (6) pressure ring compression springs LC-080J-10 SS (0.75" outside diameter, 0.080" wire diameter, 3.00" free length, spring rate of 20.23 lb/in×0.833 (for stainless steel)=16.85 lb/in, and a solid height of 10.95"; a 0.835" preload on each spring provides a total preload force of (6)×16.85 lb/in×0.835"=84.4 lbs (greater than draw ring full deflection spring load total force); an additional deflection of the springs of 0.46" (1.295" total spring deflection) results in a total full load force of (6)×16.85 lb/in×1.295"=130.9 lbs; or for example, (4) draw ring compression springs LC-067H-7 SS (0.60" outside diameter, 0.067" wire diameter, 1.75" free length, spring rate 24 lb/in×0.833 (for stainless steel)=19.99 lb/in, and a solid height of 0.705"); a 0.500" preload on each spring provides a total preload force of (4)×19.99 lb/in×0.500"=40.0 lbs; an additional deflection of the springs of 0.40" or (0.90" total spring deflection) results in a total full load force of (4)×19.99 lb/in×0.90"=72.0 lbs; (8) pressure ring compression springs LC-049E-18 SS (0.36" outside diameter, 0.049" wire diameter, 2.75" free length, spring rate of 14 lbs/in×0.833 (for stainless steel)=11.66 lb/in, and a solid height of 1.139"; a 1.00" preload on each spring provides a total preload force of (8)×11.66 lb/in×1.00"=93.3 lbs (greater than draw ring fully deflection spring load total force); an additional deflection of the springs of 0.50" (1.500" total spring deflection) results in a total full load force of (8)×11.66 lb/in×1.500"=140 lbs. The springs referred to above are available from Lee Spring Co. Many other suitable components may of course by employed when making the inventive containers from paperboard.

There is provided in accordance with the invention novel containers and manufacturing methods that provide advantages and product options not previously practical. Containers of the invention further provide for increases in rigidity and ease of separation from a nested stack as is further discussed below.

SSI Rigidity

Eight and three-quarter inch (8¾") diameter plates of the invention (nominal 9-inch) having generally the configuration shown in FIG. 1, compartmented with dual tabs, were tested for SSI rigidity and compared with a 7-⅜" diameter commercially available plate. The commercially available plate had a flat rim design and did not have central compartments, but did have two peripheral compartments configured to resemble "ears". Specifics as to caliper and results appear in Table 2.

TABLE 2

| Sample | Basis wt. (lbs/3000 ft$^2$) | Caliper (mils) | MD Plate Rigidity (grams) | CD Plate Rigidity (grams) | GM Plate Rigidity (grams) |
|---|---|---|---|---|---|
| | SSI Rigidity Values | | | | |
| 8¾" compartmented plate of invention | 225 | 20 | 169 | 329 | 235 |
| 8¾" compartmented plate of invention | 194 | 17 | 103 | 208 | 146 |
| 8¾" compartmented plate of invention | 179 | 15 | 79 | 162 | 113 |
| 7⅜" commercially available compartmented plate | 191 | 16 | 134 | 92 | 111 |

From Table 2 it is seen that there are differences in directionality of the SSI rigidity values (MDvs.CD) between the commercially available plate and the plates of the invention; those differences are believed due to the compartment ribs. The plates of the invention exhibited generally higher GM or overall SSI rigidity values as can be seen from rows 1, 2 and 3 of Table 2. The 179 lb. basis weight, 9" plate of the invention exhibited a GM rigidity slightly higher than the commercially available plate, despite the fact that the commercially available plate was smaller and had a higher basis weight. Typically, one expects higher rigidity with higher basis weights and higher rigidity with a smaller plate due to the shorter distance between the central support and load application.

Product Spacing

Figure 32:
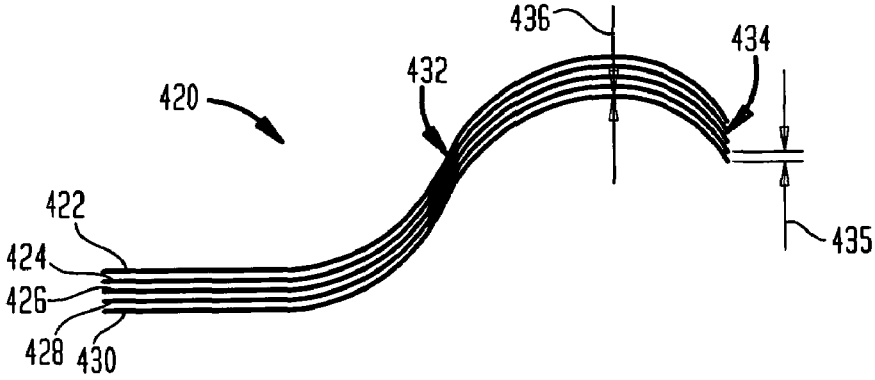
FIG. 32 is a schematic view illustrating a nested stack of conventional plates.

The tab(s) of the containers of the present invention preferably extend outwardly in a horizontal direction ±20° to parallel with respect to the container bottom. This feature is particularly useful for separating containers in a nested stack when the containers are provided with a flange which has a significant outer vertical drop since the containers nest or contact at their steep angle portions. In FIG. 32 there is shown schematically a portion of nested stack 420 plates 422, 424, 426, 428, 430 of the type described in U.S. Pat. No. 5,088,640 to Littlejohn. It can be seen that in the areas of sidewalls, indicated generally at 432, the plates are in surface-to-surface contact with each other such that there is essentially no gap between adjacent plates in this region. Likewise, at an outer edge 434 of the stack where the brims turn downwardly at a steep angle, there is little, if any, gap between adjacent plates. Thus, for nested plates having a caliper 435 of 16 mils or so, the product spacing 435 (upper edge to upper edge of adjacent plates in the stack) may be 32 mils or so, wherein there is essentially no gap between the outer angled edges of adjacent plates, making it difficult to separate them.

Figure 33:
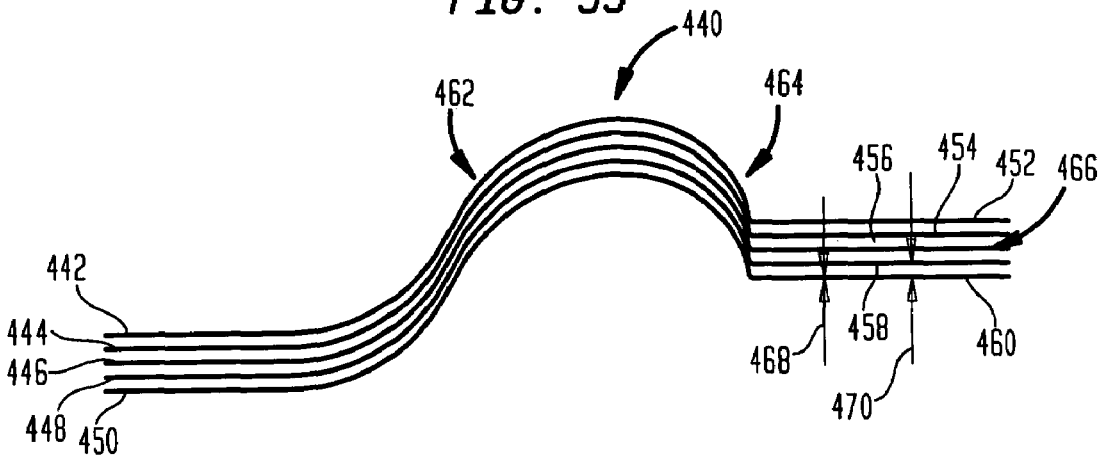
FIG. 33 is a schematic view illustrating a nested stack of plates of the invention along a tabbed portion thereof.

In FIG. 33 there is shown schematically a portion of a nested stack 440 of plates 442, 444, 446, 448, and 450 having a profile shape similar to the plates in FIG. 32 except they are provided with tabs 452, 454, 456, 458 and 460 extending outwardly from their perimeters. Here, there is again very little, if any, gap between products in the steep areas indicated at 462 and 464; however, the tabs are separated by significant gaps at outer region 466 because they are generally horizontal in region 466. Thus, for a stack of plates having a caliper 468 of 16 mils and a configuration of the present invention, there may be, for example, a product spacing 470 at region 466 of 45 mils or so. The plates or bowls may be readily separated by utilizing the tab, even if there is some "taper lock", vacuum or coating tack between adjacent containers.

Still further embodiments of the invention are illustrated in FIGS. 34 through 40. In FIGS. 34-37 there is illustrated bowls with flange tabs, one bowl 510 with two flange tabs and one bowl 512 with four flange tabs. Each bowl is provided a generally planar bottom portion 514 as well as a first annular transition portion 516 extending upwardly and outwardly from the generally planar bottom portion. A sidewall portion 518 extends upwardly and outwardly from the first annular transition portion while a second annular transition portion 520 flares outwardly from the sidewall portion. An outer flange portion 522 extends outwardly with respect to the second annular transition portion defining generally the container perimeter 524 having a characteristic diameter 526.

First and second generally planar peripheral tabs 528, 530 generally lobular in shape extend outwardly from the flange portion of the container generally beyond perimeter 524 preferably in a direction generally parallel to the generally planar bottom portion of the container, the first and second tabs are configured so as to define a first cross-tab dimension 525 between their outer edges generally parallel to and of greater length than with a corresponding transverse dimension across the perimeter of the container; in this case diameter 526.

With respect to bowl 512, third and fourth generally planar tabs 532, 534 extend outwardly from the flange portion of the container generally beyond perimeter 524 preferably in a direction generally parallel to the generally planar bottom portion of the container. The third and fourth peripheral tabs may also be configured so as to define a second cross-tab dimension 535 between their outer edges generally parallel to and of greater length than the diameter across the perimeter of the container.

Each tab extends outwardly from the perimeter of the bowl a distance 536. Likewise, the tabs define included angles therebetween as noted above in connection with plates. So also, the bowls preferably include a printed character image as shown, including ears 538, eyes 540 and so forth. The bowls are made generally as noted above in connection with FIGS. 15 through 29 and may be made from a paperboard blank the same size as one used for a plate which is of a larger diameter then the bowl. Depending on the product, the staging and geometry of the dies are suitably adjusted or changed. The cross-tab dimensions may be equal to the diameter of the central portion of the paperboard blank. The manufacturing process is unexpectedly robust in that the irregularly shaped product does not lead to difficulties and the product readily stacks. Moreover, taper lock is ameliorated as noted above.

Figure 34:
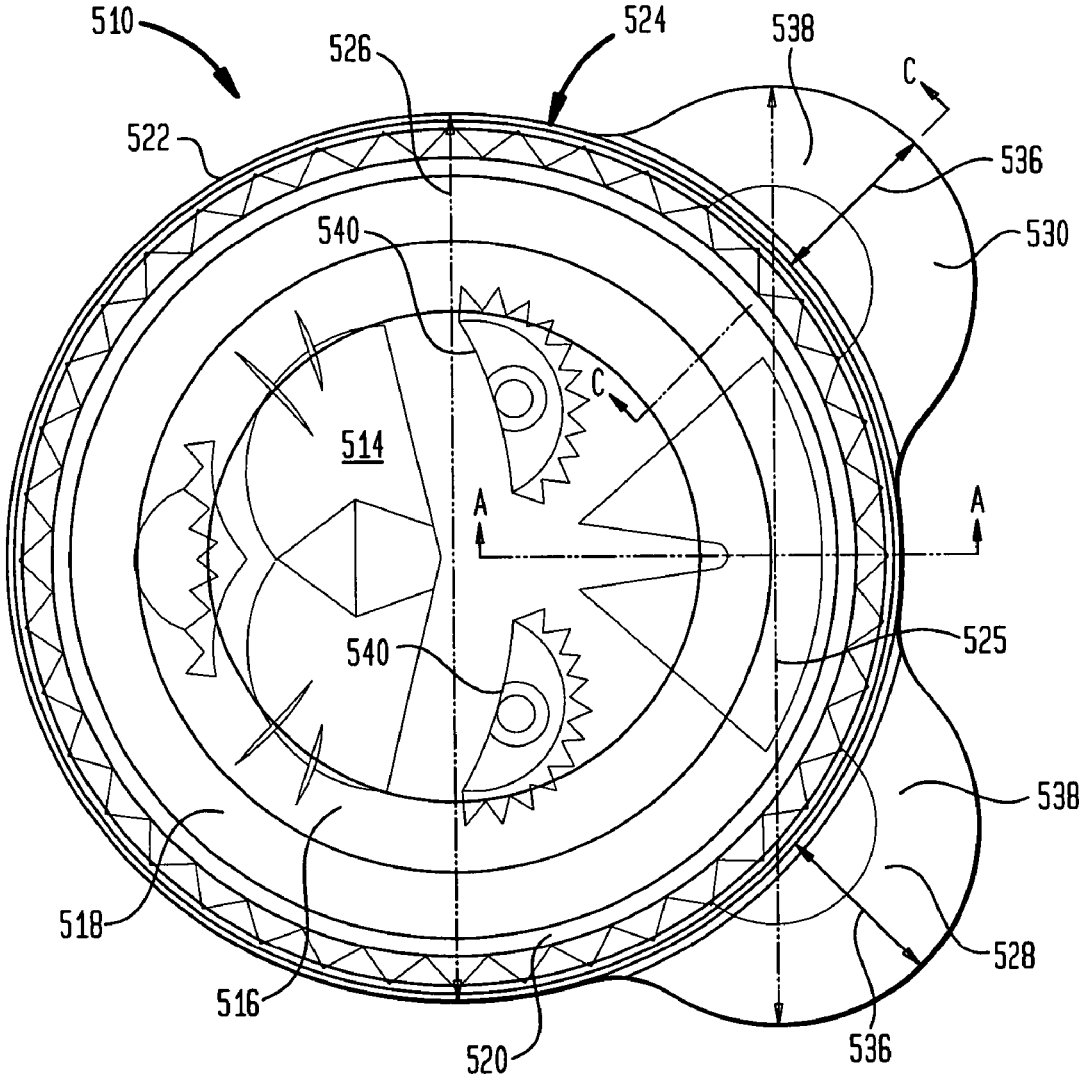
FIG. 34 is a plan view of a two-tab bowl constructed in accordance with the present invention.
Figure 35:
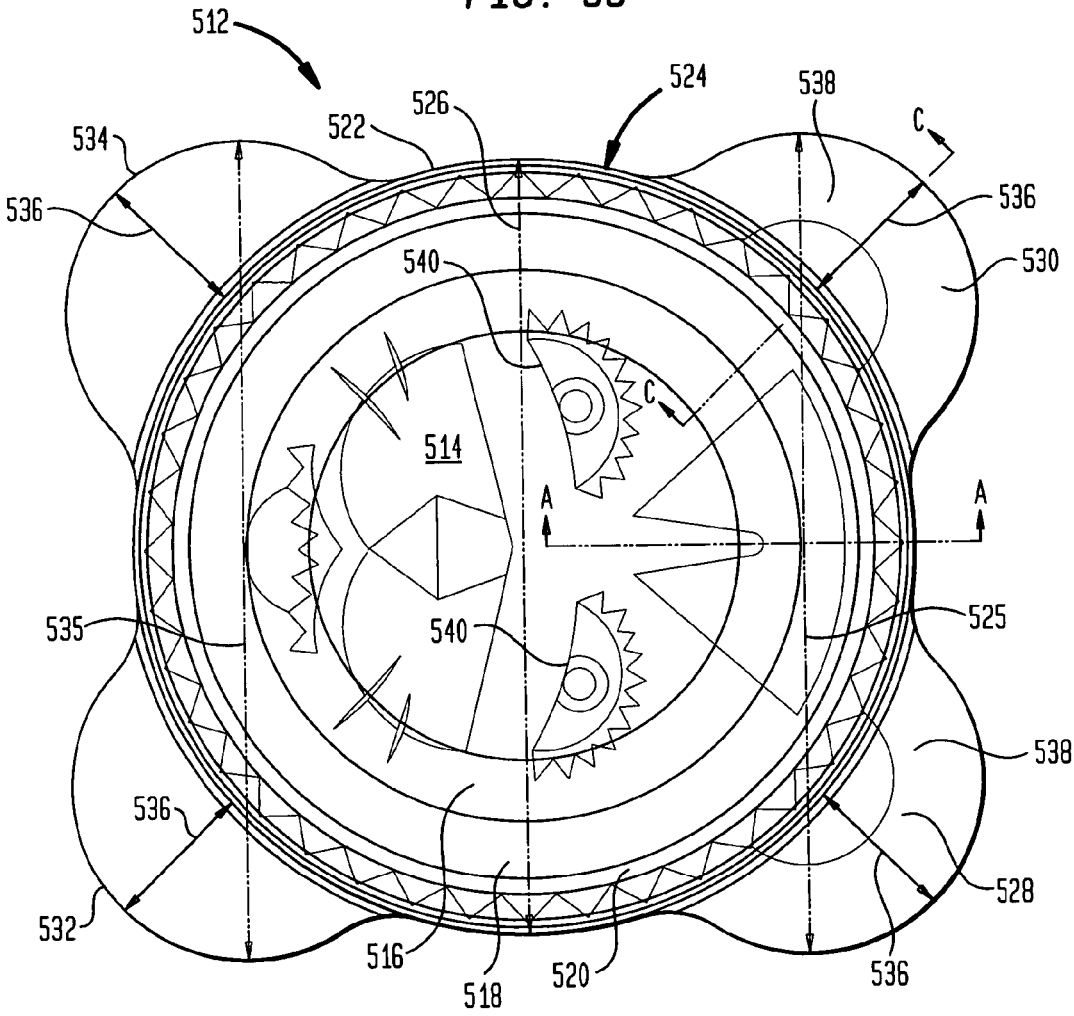
FIG. 35 is a plan view of a four-tab bowl constructed in accordance with the present invention.
Figure 36:
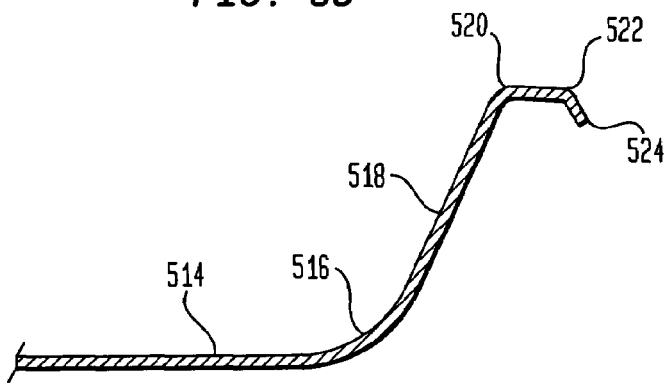
FIGS. 36 and 37 are details of the bowls of FIGS. 34 and 35.
Figure 37:
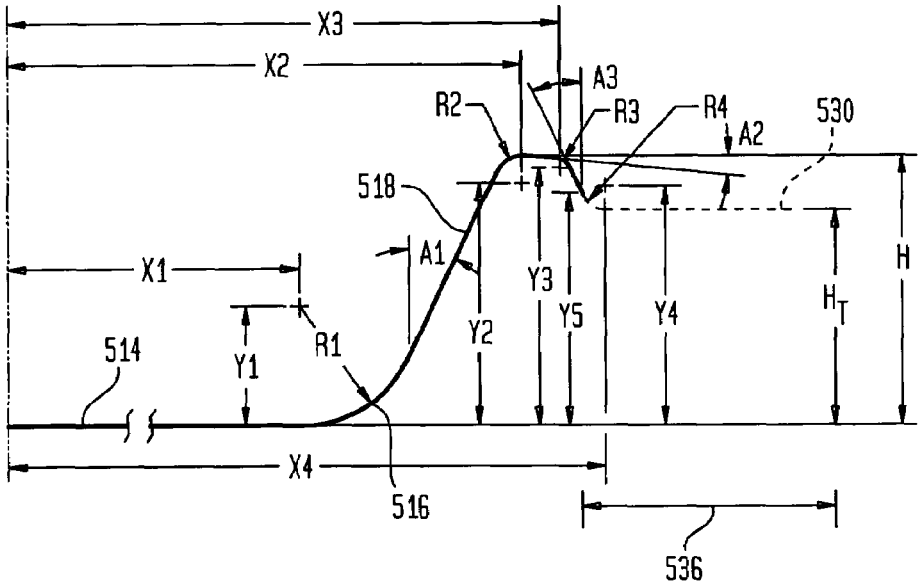

Details of bowl construction are better appreciated from FIGS. 36 and 37 which are along lines A-A and C-C of FIGS. 34 and 35. FIG. 37 is a composite view along lines A-A and C-C illustrating the various dimensions wherein X1 is the distance from center of the origin of the radius of curvature R1 of the first annular transition section; X2 is the distance from center of the origin of the radius of curvature R2 of the second annular transition section; X3 is the distance from center of a third radius of curvature R3 in the outer flange and X4 is the distance from center of the origin of the radius of curvature R4 which transitions to tab 530. Y1 is the height from the bottom of the container of the origin of R1; Y2 is the height from the bottom of the container of the origin of R2 and likewise, Y3 and Y4 are the heights of the origins of R3 and R4 from the bottom of the container. Y5 is the height (from bottom) of the perimeter of the central portion of the bowl sometimes referred to as the brim height, $H_b$. H is the product height (from bottom) and $H_T$ is the height of the tabs (which are all equal in the embodiments shown in FIGS. 34 through 37). An example of dimensional relationships are shown below in Table 3.

TABLE 3

| Relative Bowl Dimensions | |
|---|---|
| R1/D = 0.106* | R4/D = 0.021 |
| X1/D = 0.255 | X4/D = 0.522 |
| Y1/D = 0.106 | Y4/D = 0.215 |
| R2/D = 0.024 | Y5/D = 0.215 |
| X2/D = 0.451 | $H_T$/D= 0.195 |
| Y2/D = 0.217 | H/D = 0.241 |
| R3/D = 0.009 | A1 = 25.0 degrees |
| X3/D = 0.483 | A2 = 5.5 degrees (downward from horizontal) |
| Y3/D = 0.230 | A2 = 25.0 degrees |

*Ratio with product diameter, e.g., diameter 526 in FIGS. 34 and 35

Figure 38:
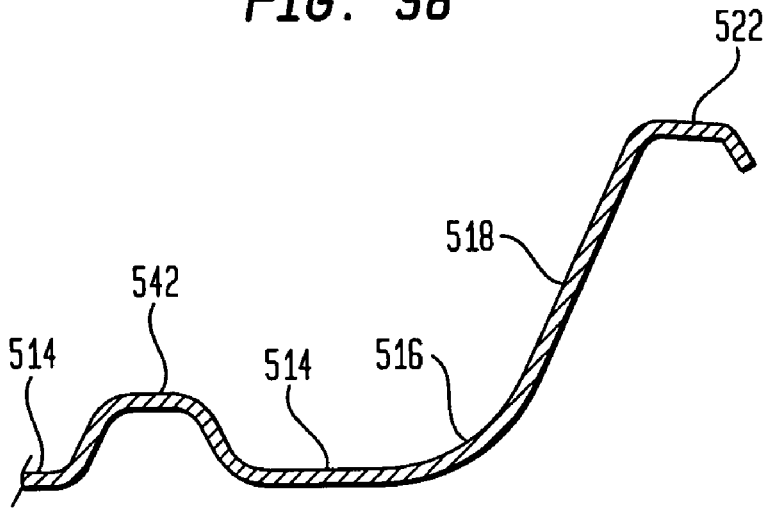
FIG. 38 is a detail of an alternate construction of the bowls of FIGS. 34 and 35 wherein the bottom potion of the bowl is provided with a debossment.
Figure 39:
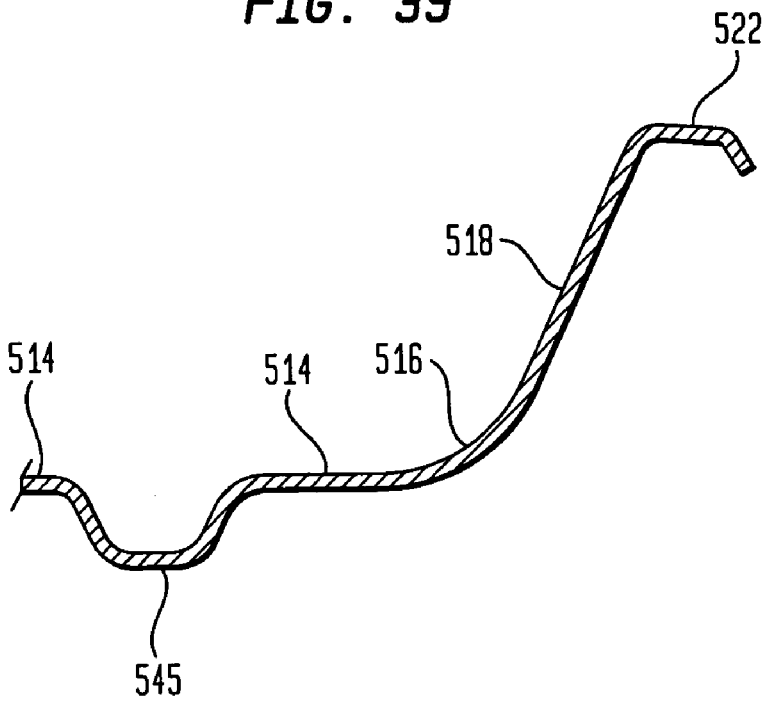
FIG. 39 is a detail of an alternate construction of the bowls of FIGS. 34 and 35 wherein the bottom portion of the bowl is provided with an embossment.

Still further embodiments of the invention include debossments in the bottom portion of the container such as debossment 542 shown in profile in FIG. 38 or further embodiments include embossments in, the bottom of the container as shown in FIG. 39 as embossment 545. Preferably when embossments or debossments are provided in the bottom of the container, there are provided a plurality of these shape features in correspondence with a printed image. For example, debossments such as 540 are provided at the eyes shown in FIG. 34 or 35 or embossments are added to embellish character attributes.

Figure 40:
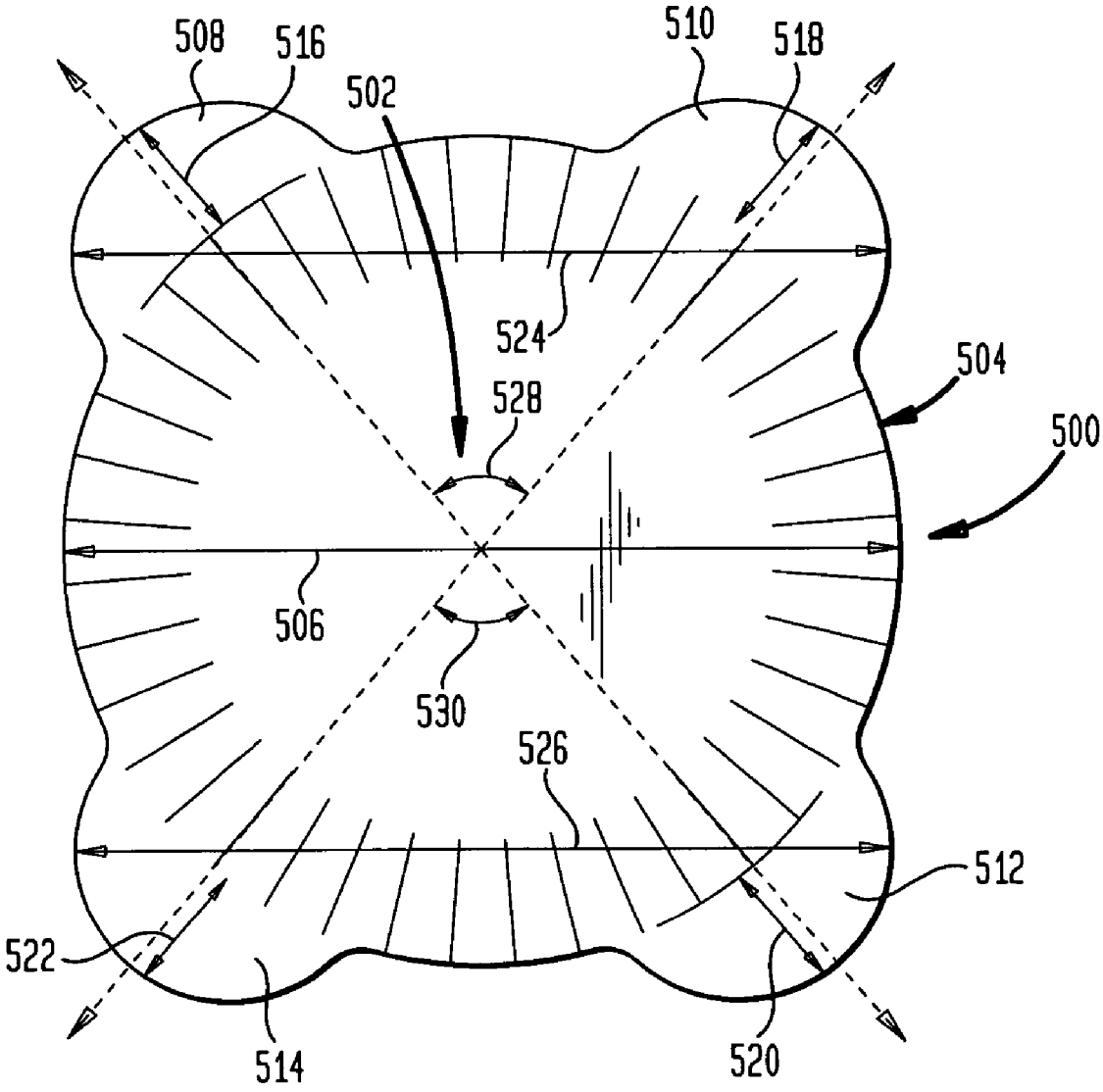
FIG. 40 is a plan view of a four-tab paperboard blank used for making bowls and plates in accordance with the invention.

A suitable four-tab paperboard blank for using a container in accordance with the invention is shown in FIG. 40. There is shown a paperboard blank 500 having a plurality of scores (40 for a plate, 80 for a bowl). Blank 500 includes a central portion 502 having a perimeter 504 defining a diameter 506. These are provided tabs 508, 510, 512 and 514 which extend peripheral distances 516, 518, 520 and 522 beyond the perimeter of the central portion. The tabs define two cross-tab dimensions 524, 526 which are of equal length with each other and diameter 506. In some cases, it is preferred to have cross-tab dimensions 524, 526 equal to each other but of a greater length than diameter 506. In still other cases, at least 2 of the tabs define a cross-tab dimension equal in length to diameter 506.

Tabs 508, 510 are offset from one another by an included angle 528; while tabs 512, 514 are offset by an included angle 530. The included angle is the angle between the center lines of the tabs as shown in dashed lines at their intersection in the blank center. Typically angles 528 and 530 are between 70 to 90° and are preferably equal to each other.

When blank 500 is formed into a plate, the cross-tab dimensions of the product are substantially equal in length to the diameter of the central portion of the plate; however, when blank 500 is formed into a deep draw product such as a bowl or deep dish container, the cross-tab dimensions of the product may be greater in length then the diameter of the central portion of the bowl. A four-tab construction in such cases with two equal cross-tab dimensions allows one to control the orientation of the product by way of the tabs for purposes of packaging the product as will be appreciated by one of skill in the art.

While the invention has been described in detail in connection with numerous embodiments and figures, various modifications within the spirit and scope of the appended claims will be readily apparent to those of skill in the art.

What is claimed is:

1. A disposable servingware container comprising: a generally planar bottom portion; a first annular transition portion extending upwardly and outwardly from the generally planar bottom portion; an optional sidewall portion extending upwardly and outwardly from the first annular transition portion; a second annular transition portion flaring outwardly with respect to the first annular transition portion; an outer flange portion extending outwardly with respect to the second annular transition portion defining generally the container perimeter having a characteristic diameter; and at least first and second generally planar peripheral tabs extending outwardly from the flange portion of the container generally beyond the container perimeter, the peripheral tabs being configured so as to define a first cross-tab dimension between their outer edges generally parallel to and of like extent with a corresponding transverse dimension across the perimeter of the container.

2. The disposable servingware container according to claim 1, wherein said first and second tabs extend outwardly from the perimeter of the container a distance of from about 0.02 to about 0.3 times the characteristic diameter.

3. The disposable servingware container according to claim 1, having a generally round shape such that the container perimeter is a circle having a diameter, D, and wherein the first cross-tab dimension defined by the first and second peripheral tabs is generally equal in length to the diameter, D.

4. The disposable servingware container according to claim 3, wherein the ratio of the height of the container to the characteristic diameter thereof is from about 0.05 to about 0.3.

5. The disposable servingware container according to claim 4, wherein there are provided at least 2 upwardly projecting ribs which divide the container into at least 2 serving sections, one of which areas occupies at least about 60 percent of the bottom portion of the container.

6. The disposable servingware container according to claim 1, wherein said first and second peripheral tabs have an arcuate outer edge.

7. The disposable servingware container according to claim 6, wherein the outer edges of the first and second peripheral tabs have a radius of curvature of from about 0.01 to about 0.4 times the characteristic diameter of the container.

8. The disposable servingware container according to claim 1, formed of paper.

9. The disposable servingware container according to claim 8, press-formed from a paperboard blank.

10. The disposable servingware container according to claim 9, wherein at least one surface of said paperboard blank is provided with a substantially liquid-impervious coating comprising an inorganic pigment or filler and a water-based, press applied overcoat.

11. The disposable servingware container according to claim 10, wherein at least one surface of said paperboard blank is provided with a styrene-butadiene polymer coating.

12. The disposable servingware container according to claim 1, formed of a thermoplastic composition.

13. The disposable servingware container according to claim 12, fabricated from a thermoplastic material by way of a technique selected from the group consisting of injection molding, injection blow molding, injection stretch molding and composite injection molding.

14. The disposable servingware container according to claim 12, formed from a foamed polymeric material.

15. The disposable servingware container according to claim 12, formed from sheet stock of thermoplastic material.

16. The disposable servingware container according to claim 12, thermoformed, thermoformed by the application of vacuum or thermoformed by a combination of vacuum and pressure.

17. The disposable servingware container according to claim 12, thermoformed by the application of vacuum.

18. The disposable servingware container according to claim 12, wherein said thermoplastic composition is a foamed or solid polymeric material selected from the group consisting of: polyamides, polyacrylates, polysulfones, polyetherketones, polycarbonates, acrylics, polyphenylene sulfides, acetals, cellulosic polymers, polyetherimides, polyphenylene ethers or oxides, styrene-maleic anhydride copolymers, styrene-acrylonitrile copolymers, polyvinylchlorides and mixtures thereof.

19. The disposable servingware container of claim 12, wherein said thermoplastic composition comprises a foamed or solid polymeric material selected from the group consisting of: polyesters, polystyrenes, polypropylenes, polyethylenes and mixtures thereof.

20. The disposable servingware container according to claim 19, thermoformed from mineral-filled polypropylene sheet stock.

21. The disposable servingware container according to claim 20, wherein said mineral filler is predominantly mica.

22. The disposable servingware container according to claim 20, having a wall thickness from about 10 to about 80 mils and consisting essentially of from about 40 to about 90 percent by weight of a polypropylene polymer, from about 10 to about 60 percent by weight of a mineral filler, from about 1 to about 15 percent by weight polyethylene, up to about 5 weight percent titanium dioxide and optionally including a basic organic or basic inorganic compound comprising the reaction product of an alkali metal or alkaline earth element with carbonates, phosphates, carboxylic acids as well as alkali metal and alkaline earth element oxides, hydroxides, or silicates and basic metal oxides, including mixtures of silicon dioxide with one or more of the following oxides: magnesium oxide, calcium oxide, barium oxide, and mixtures thereof.

23. The disposable servingware container according to claim 12, having a wall caliper of from about 10 to about 50 mils.

24. The disposable servingware container according to claim 23, having a wall caliper of from about 15 to about 25 mils.

25. The disposable servingware container according to claim 12, formed of a styrene polymer composition.

26. The disposable servingware container according to claim 25, formed of polystyrene.

27. The disposable servingware container according to claim 12, formed from a mineral-filled thermoplastic composition.

28. A disposable servingware container press-formed from a generally planar paperboard blank comprising: a generally planar bottom portion; a first annular transition portion extending upwardly and outwardly from the generally planar bottom portion; an optional sidewall portion extending upwardly and outwardly from the first annular transition portion; a second annular transition portion flaring outwardly with respect to the first annular transition portion; an outer flange portion extending outwardly with respect to the second annular transition portion defining a container perimeter having a characteristic diameter, D; and at least first and second generally planar peripheral tabs extending outwardly from the flange portion of the container generally beyond the container perimeter, the peripheral tabs being configured so as to define a cross-tab dimension between their outer edges of generally parallel to and of like extent with a corresponding transverse dimension across the perimeter of the container.

29. The disposable servingware container according to claim 28, having a caliper of at least about 10 mils.

30. The disposable servingware container according to claim 28, having a generally round shape such that the container perimeter is a circle having a diameter, D, and wherein the cross-tab dimension defined by the first and second peripheral tabs is generally equal in length to the diameter, D.

31. The disposable servingware container according to claim 30, wherein the ratio of the height of the container to diameter, D, is from about 0.05 to about 0.3 and wherein said generally planar bottom portion is provided with a plurality of upwardly projecting ribs which divide the container into a plurality of serving sections.

32. The disposable servingware container according to claim 28, wherein there are provided 3 upwardly projecting ribs which divide the container into 3 serving sections, one of which areas occupies at least about 60 percent of the bottom portion of the container.

33. The disposable servingware container according to claim 30, wherein said first and second tabs extend outwardly from the perimeter of the container a distance of from about 0.02 to about 0.3 times the diameter, D, of the container.

34. The disposable servingware container according to claim 30, wherein said first and second peripheral tabs have an arcuate outer edge.

35. A disposable servingware container comprising: a generally planar bottom portion; a first annular transition portion extending upwardly and outwardly from the generally planar bottom portion; an optional sidewall portion extending upwardly and outwardly from the first annular transition portion; a second annular transition portion flaring outwardly with respect to the first annular transition portion; an outer flange portion extending outwardly with respect to the second annular transition; wherein the container is characterized by a container height, H; the outer flange portion being characterized by a vertical drop wherein the ratio of the flange outer vertical drop to the characteristic diameter of the container is greater than about 0.01 such that the outer edge of the container terminates below the height, H, of the container, generally at a brim height, $H_b$; and a generally planar peripheral tab extending outwardly from the flange portion of the container over a distance of at least about 0.02 times the characteristic diameter of the container at a height, $H_T$, below the height, H, of the container, wherein said peripheral tab extends outwardly from the flange at a tab height, $H_T$, which is lower than the brim height, $H_b$, and wherein the disposable servingware container is formed from a paperboard blank.

36. The disposable servingware container according to claim 35, wherein the peripheral tab extends outwardly from the flange a distance of from about 0.02 to about 0.3 times the characteristic diameter.

37. The disposable servingware container according to claim 36, wherein the peripheral tab extends outwardly from the perimeter a distance of from about 0.1 to about 0.3 times the characteristic diameter of the container.

38. The disposable servingware container according to claim 35, wherein the outer flange portion of the container comprises an arcuate outer flange portion with a convex upper surface, the radius of curvature of the arcuate outer flange portion being between about 0.0175 and about 0.1 times the characteristic diameter of the container.

39. The disposable servingware container according to claim 35, wherein the ratio of the flange outer vertical drop to the diameter, D, of the container is greater than about 0.013.

40. A generally planar paperboard blank suitable for press-forming into a disposable pressware container comprising: a central portion defining generally a perimeter thereof having a characteristic diameter; at least first and second peripheral tabs extending outwardly from the central portion beyond the perimeter of the central portion, the peripheral tabs being configured so as to define a cross-tab dimension between their outer edges generally parallel to and of like extent with a corresponding transverse dimension across the perimeter of the blank.

41. The paperboard blank according to claim 40, the central portion having a circular shape defining a diameter, D' and wherein the cross-tab dimension defined by the first and second peripheral tabs is generally equal in length to diameter, D'.

42. The paperboard blank according to claim 40, wherein said first and second peripheral tabs have an arcuate outer edge.

43. The paperboard blank according to claim 42, wherein the outer edges of the first and second peripheral tabs have a radius of curvature of from about 0.01 to about 0.4 times the characteristic diameter of the paperboard blank.

44. The paperboard blank according to claim 40, having a caliper of at least about 10 mils.

45. The paperboard blank according to claim 40, wherein the first and second peripheral tabs define an angle therebetween less than about 150°.

46. A generally planar paperboard blank suitable for press-forming into a disposable pressware container comprising: a central portion defining generally a perimeter thereof having a characteristic diameter; first and second peripheral tabs extending outwardly from the central portion beyond the perimeter of the central portion, the first and second peripheral tabs being configured so as to define a first cross-tab dimension between their outer edges generally parallel to and of greater length than a corresponding transverse dimension across the perimeter of the blank; third and fourth peripheral tabs extending outwardly from the central portion beyond the perimeter of the central portion, the third and fourth peripheral tabs being configured so as to define a second cross-tab dimension between their outer edges generally parallel to and of greater length than the corresponding transverse dimension across the perimeter of the blank; and wherein the first and second cross-tab dimensions are generally equal in length.

47. The paperboard blank according to claim 46, wherein the central portion is circular and defines a diameter, D', and wherein the first and second cross-tab dimensions are greater than the diameter, D'.

48. A disposable servingware container comprising: a generally planar bottom portion; a first annular transition portion extending upwardly and outwardly from the generally planar bottom portion; an optional sidewall portion extending upwardly and outwardly from the first annular transition portion; a second annular transition portion flaring outwardly with respect to the first annular transition portion; an outer flange portion extending outwardly with respect to the second annular transition portion defining generally the container perimeter having a characteristic diameter; and first and second generally planar peripheral tabs extending outwardly from the flange portion of the container generally beyond the container perimeter, the first and second peripheral tabs being configured so as to define a first cross-tab dimension between their outer edges generally parallel to and of greater length than with a corresponding transverse dimension across the perimeter of the container.

49. The disposable servingware container according to claim 48, wherein the container perimeter is circular and defines a diameter, D, and the first cross-tab dimensions are of a length greater than D.

50. The disposable servingware container according to claim 49, formed as a bowl having a height to diameter ratio of at least 0.15.

51. A disposable servingware container comprising: a generally planar bottom portion; a first annular transition portion extending upwardly and outwardly from the generally planar bottom portion; an optional sidewall portion extending upwardly and outwardly from the first annular transition portion; a second annular transition portion flaring outwardly with respect to the first annular transition portion; an outer flange portion extending outwardly with respect to the second annular transition portion defining generally the container perimeter having a characteristic diameter; first and second generally planar peripheral tabs extending outwardly from the flange portion of the container generally beyond the container perimeter, the first and second peripheral tabs being configured so as to define a first cross-tab dimension between their outer edges generally parallel to and of greater length than with a corresponding transverse dimension across the perimeter of the container; and third and fourth generally planar peripheral tabs extending outwardly from the flange portion of the container generally beyond the container perimeter, the third and fourth peripheral tabs being configured so as to define a second cross-tab dimension between their outer edges generally parallel to and of greater length than with a corresponding transverse dimension across the perimeter of the container.

52. The disposable servingware container according to claim 51, wherein the container perimeter is circular and defines a diameter, D, and the first and second cross-tab dimensions are generally equal in length and of a length greater than D.

53. The disposable servingware container according to claim 52, formed as a bowl having a height to diameter ratio of at least 0.15.

54. The disposable servingware container according to claim 53, formed as a bowl having a height to diameter ratio from about 0.175 to about 0.3.

* * * * *